US010006177B2

(12) United States Patent
Doak et al.

(10) Patent No.: US 10,006,177 B2
(45) Date of Patent: Jun. 26, 2018

(54) WORKSTATION FOR FLAGMAN

(71) Applicant: NOVA Chemicals Inc., Moon Township, PA (US)

(72) Inventors: Robert Doak, Wexford, PA (US); Bryan Kirsten, Cranberry Township, PA (US)

(73) Assignee: NOVA Chemicals Inc., Moon Township, PA (US)

( * ) Notice: Subject to any disclaimer, the term of this patent is extended or adjusted under 35 U.S.C. 154(b) by 180 days.

(21) Appl. No.: 15/272,727

(22) Filed: Sep. 22, 2016

(65) Prior Publication Data

US 2017/0081813 A1 Mar. 23, 2017

Related U.S. Application Data

(60) Provisional application No. 62/317,014, filed on Apr. 1, 2016, provisional application No. 62/222,414, filed on Sep. 23, 2015.

(51) Int. Cl.

| | |
|---|---|
| ***E01F 1/00*** | (2006.01) |
| ***G09F 7/22*** | (2006.01) |
| ***G09F 15/00*** | (2006.01) |
| *G09F 7/18* | (2006.01) |

(52) U.S. Cl.

CPC ..... *E01F 1/005* (2013.01); *G09F 7/22* (2013.01); *G09F 15/0037* (2013.01); *G09F 2007/1878* (2013.01)

(58) Field of Classification Search

CPC .... E01F 1/00; E01F 1/005; G09F 7/22; G09F 15/0037; G09F 2007/1878

USPC ..... 116/63 R, 63 P; 248/621, 633; 40/612

See application file for complete search history.

(56) References Cited

U.S. PATENT DOCUMENTS

| | | | | |
|---|---|---|---|---|
| 1,317,819 | A * | 10/1919 | Peck | E01F 1/005 116/63 P |
| 1,747,352 | A * | 2/1930 | Dennis, Jr. | E01F 1/005 108/57.12 |
| 1,750,190 | A * | 3/1930 | Pavelsky | E01F 1/005 116/63 R |
| 2,983,692 | A | 5/1961 | D'Alelio | |
| 3,023,175 | A | 2/1962 | Rodman, Jr. | |

(Continued)

FOREIGN PATENT DOCUMENTS

| | | | | |
|---|---|---|---|---|
| DE | 2905769 A1 * | 8/1980 | | E01F 1/005 |
| DE | 20018156 U1 * | 12/2000 | | E01F 1/005 |

(Continued)

OTHER PUBLICATIONS

ASTM C 203-99; Standard Test Methods for Breaking Load and Flexural Properties of Block-TypeThermal Insulation; copyright ASTM International; Current edition approved Mar. 10, 2009. Published May 1999. Originally published as C 203-45 T. Replaced C 165-41 T and C203-551. Last previous edition C 203-92; pp. 1-6.

(Continued)

*Primary Examiner* — R. A. Smith
(74) *Attorney, Agent, or Firm* — Gary F. Matz

(57) ABSTRACT

The present invention generally relates to an apparatus for traffic control and safety. More particularly, the present invention provides a platform adapted to support a flagman and optionally a pole mounted sign to control the flow of traffic near road construction or other similar sites.

20 Claims, 11 Drawing Sheets

(56) References Cited

U.S. PATENT DOCUMENTS 3,959,180 A 5/1976 Bittner et al.
3,959,189 A 5/1976 Kitamori
4,049,594 A 9/1977 Ikeda et al.
4,168,353 A 9/1979 Kitamori
4,295,236 A * 10/1981 Upchurch ..... B63B 1/121 114/357
4,303,756 A 12/1981 Kajimura et al.
4,303,757 A 12/1981 Kajimura et al.
4,429,059 A 1/1984 Ozutsumi et al.
4,777,751 A * 10/1988 Pasquale ..... E01F 1/005 182/17
5,422,638 A 6/1995 Singer et al.
6,127,439 A 10/2000 Berghmans et al.
6,160,027 A 12/2000 Crevecoeur et al.
6,242,540 B1 6/2001 Crevecoeur et al.
6,908,949 B2 6/2005 Arch et al.
7,155,850 B2 * 1/2007 Wilinsky, Jr. et al. . G09F 15/00 116/63 P
7,638,559 B2 12/2009 Petela et al.
8,104,575 B1 * 1/2012 Bancroft ..... E01C 9/086 182/45
8,133,125 B2 * 3/2012 Park ..... A63B 69/0002 473/218
8,360,896 B2 * 1/2013 Hackenberg ..... A63B 69/3673 473/278
8,678,985 B2 * 3/2014 Mattox ..... A63B 21/0004 482/142
9,399,502 B1 * 7/2016 Cruz Ricardez ..... B63B 1/04
9,420,893 B1 * 8/2016 Clark ..... A47C 16/04
2002/0117769 A1 8/2002 Arch et al.
2005/0242630 A1 * 11/2005 Miller ..... A01K 97/00 297/4
2007/0298949 A1 * 12/2007 Soletski ..... A61H 1/0266 482/146
2009/0021389 A1 1/2009 Entrup

FOREIGN PATENT DOCUMENTS

DE 202005018569 U1 * 1/2006 ..... E01F 1/005
EP 0997580 A2 * 5/2000 ..... E01F 1/00

OTHER PUBLICATIONS

ASTM D3575-14; Standard Test Methods for Flexible Cellular Materials Made From Olefin Polymers; Copyright ASTM International; Current edition approved Jan. 1, 2014. Published Jan. 2014. Originally approved in 1977. Last previous edition approved in 2008 as D3575-08; pp. 1-11.

* cited by examiner

WORKSTATION FOR FLAGMAN

REFERENCE TO RELATED APPLICATION

This application claims the benefit of priority of U.S. Provisional Application Ser. No. 62/317,014 filed Apr. 1, 2016, entitled "Workstation for Flagman", and U.S. Provisional Application Ser. No. 62/222,414 filed Sep. 23, 2015, entitled "Workstation for Flagman" which are both herein incorporated by reference in their entirety.

BACKGROUND

1. Field of the Invention

The present invention generally relates to an apparatus for traffic control and safety. More particularly, the present invention provides a platform adapted to insulate a flagman from the temperature or other hazards of a road surface and optionally support a pole mounted sign or other apparatus to control the flow of traffic near road construction or other similar sites.

2. Description of the Prior Art

Traffic control is useful for a variety of traffic situations, such as road construction or vehicular accidents. Oftentimes in such situations, it is necessary to shut down one or more lanes of a roadway. A flagman is frequently utilized to accomplish this task, especially when conditions are in a state of flux. Depending on the size and state of conditions, several flagmen may be used in conjunction with each other. A flagman will generally use a pole mounted sign to convey their message to oncoming motorists. Usually, the sign has the ability to be rotated and thus can typically carry two messages for more precise control of motorists, such as "stop" on one side and "slow" on the reverse. If two or more flagmen are working together in a traffic control situation, they are generally in close communication with each other, either directly or through radio transmission. Flagmen serve two main purposes: to convey up to the second information to motorists and to significantly increase the conspicuousness and seriousness of the road condition situation to motorists.

To be effective, the flagman must be in plain view of oncoming traffic. This means that the flagman is required to stand on the road surface for long periods of time. This becomes problematic, especially at very cold or very warm temperatures, or when ponding of water from rain occurs. Thus, it would be desirable to provide a workstation for a flagman that can insulate him from surface conditions while aiding his ability to operate his pole mounted sign.

In order to address the issue of human safety on sites where traffic control is necessary, remotely controlled devices have been utilized. U.S. Pat. No. 5,422,638 to Singer et al., discloses a two faced sign that can be remotely operated from a safe distance. U.S. Patent Application Publication No. 2009/0021389 discloses a remote controlled traffic control apparatus that includes a base structure; a figurine supported by the base structure, and a means for creating a perceptible safety warning. However, most state Departments of Transportation prefer to have flagman directing the flow of traffic personally in order to better facilitate efficient vehicular movement through traffic controlled area.

SUMMARY OF THE INVENTION

The present invention is directed to a workstation, trapezoidal in shape, comprising a base, tapered sides, a top surface and a bottom surface; where the workstation includes an expandable polymer matrix having a density of at least 5 kg/m$^3$.

The present invention is also directed to a platform that includes a base, at least one riser having a top surface extending from one side of the base and at least one depression in the top surface adapted to receive a traffic control device and a flagman. The platform includes an expandable polymer matrix having a density of at least 5 kg/m3.

Other aspects of the present invention are directed to a method of controlling the flow of traffic that includes placing a flagman workstation at both ends of a portion of roadway where traffic is to be controlled: stationing a flagman standing on the upper surface of each flagman workstation equipped with a pole mounted sign having a male end and a sign end, the sign having a first directional message on a first side and a second directional message on a second side; and rotating the pole mounted sign so that the traffic entering the controlled roadway views the appropriate message.

DETAILED DESCRIPTION OF THE INVENTION

Figure 1:
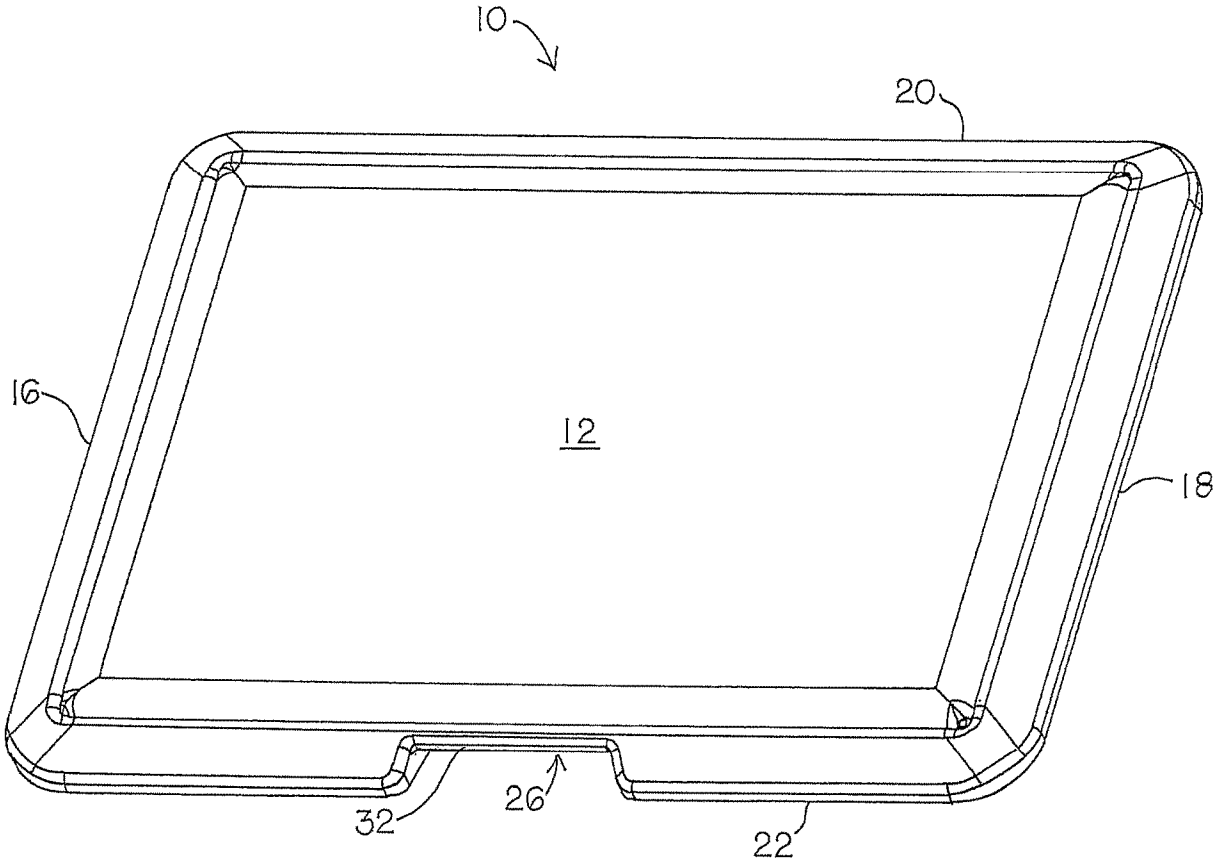
FIG. 1 is a top perspective view of a flagman workstation according to the invention.
Figure 2:
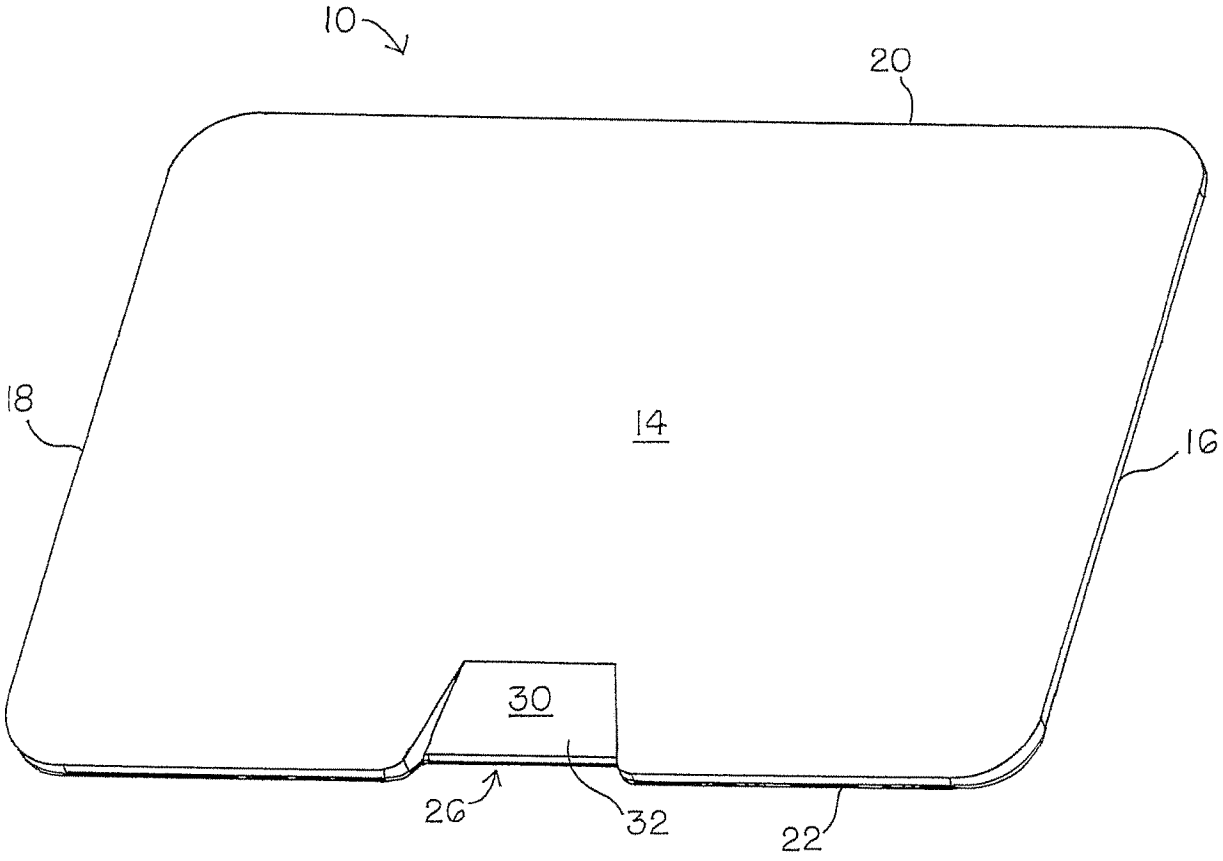
FIG. 2 is a bottom perspective view of a flagman workstation according to the invention.
Figure 4:
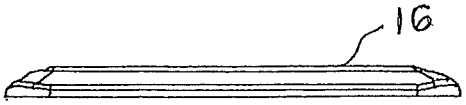
FIG. 4 is a left side elevation view of a flagman workstation according to the invention.
Figure 5:
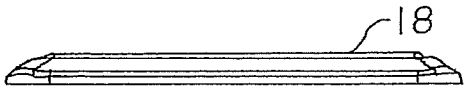
FIG. 5 is a right side elevation view of a flagman workstation according to the invention.
Figure 3:
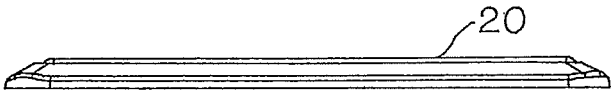
FIG. 3 is a rear elevation view of a flagman workstation according to the invention.
Figure 6:
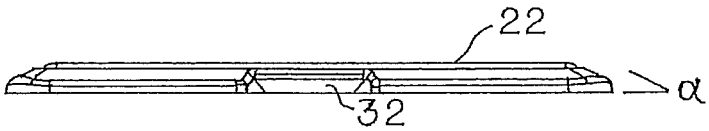
FIG. 6 is a front elevation view of a flagman workstation according to the invention.
Figure 7:
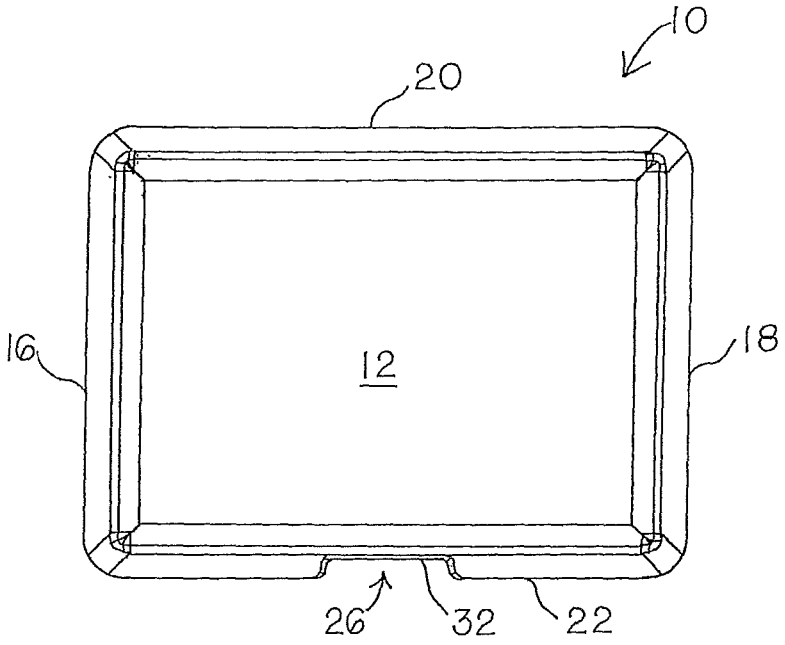
FIG. 7 is a top plan view of a flagman workstation according to the invention.
Figure 8:
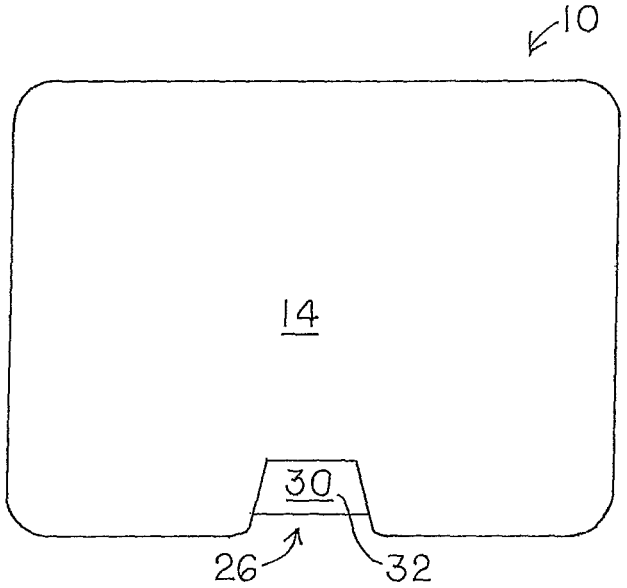
FIG. 8 is a bottom plan view of a flagman workstation according to the invention.

For the purpose of the description hereinafter, the terms "upper", "lower", "inner", "outer", "right", "left", "vertical", "horizontal", "top", "bottom", and derivatives thereof, shall relate to the invention as oriented in the drawing Figures. However, it is to be understood that the invention may assume alternate variations and step sequences except where expressly specified to the contrary. It is also to be understood that the specific devices and processes, illustrated in the attached drawings and described in the following specification, is an exemplary embodiment of the present invention. Hence, specific dimensions and other physical characteristics related to the embodiment disclosed herein are not to be considered as limiting the invention. In describing the embodiments of the present invention, reference will be made herein to the drawings in which like numerals refer to like features of the invention.

Other than in the operating examples or where otherwise indicated, all numbers or expressions referring to quantities of ingredients, reaction conditions, etc. used in the specification and claims are to be understood as modified in all instances by the term "about". Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

As used herein, the term "expandable polymer matrix" refers to a polymeric material in particulate or bead form that is impregnated with a blowing agent such that when the particulates and/or beads are placed in a mold and heat is applied thereto, evaporation of the blowing agent (as described below) effects the formation of a cellular structure and/or an expanding cellular structure in the particulates and/or beads and the outer surfaces of the particulates and/or beads fuse together to form a continuous mass of polymeric material conforming to the shape of the mold.

As used herein, the terms "expanded plastics" and "expanded resin beads" refer to thermoplastic particles that have been impregnated with a blowing agent, at least some of which is subsequently removed (as a non-limiting example, heated and expanded followed by evaporation and diffusion out of the bead) in a way that increases the volume of the particles and accordingly decreases their bulk density.

As used herein, the term "thermoplastic" refers to materials that are capable of softening, fusing, and/or modifying their shape when heated and of hardening again when cooled.

As used herein the term "poly(meth)acrylate" refers to polymers substantially containing monomer residues derived from $C_1$-$C_4$ esters of acrylic and/or methacrylic acid.

As used herein, the term "polymer" is meant to encompass, without limitation, homopolymers, copolymers and graft copolymers.

As used herein, the term "polyolefin" refers to a polymer prepared from at least one olefinic monomer, such as alpha unsaturated $C_2$-$C_{32}$ linear or branched alkenes, non-limiting examples which include ethylene, propylene, 1-butene, 1-hexene and 1-octene.

As used herein, the term "polyethylene" refers to and includes not only a homopolymer of ethylene, but also an ethylene copolymer containing units of at least 50 mole %, in some cases, at least 70 mole %, and in other cases at least 80 mole % of an ethylene unit and a corresponding proportion of units from a monomer copolymerizable with ethylene, and blends containing at least 50% by weight, in some cases at least 60% by weight, and in other cases at least 75% by weight of an ethylene homopolymer or copolymer with another polymer.

Non-limiting examples of monomers that can be copolymerized with ethylene include vinyl acetate, vinyl chloride, propylene, 1-butene, 1-hexene, 1-octene, and (meth)acrylic acid and its esters.

Polymers that can be blended with ethylene homopolymers or copolymers include any polymer compatible with ethylene homopolymers or copolymers. Non-limiting examples of polymers that can be blended with ethylene homopolymers or copolymers include polypropylene, polybutadiene, polyisoprene, polychloroprene, chlorinated polyethylene, polyvinyl chloride, styrene/butadiene copolymers, vinyl acetate/ethylene copolymers, acrylonitrile/butadiene copolymers, styrene/butadiene/acrylonitrile copolymers, and vinyl chloride/vinyl acetate copolymer.

As used herein, the term "styrenic polymers" refers to homopolymers of styrenic monomers and copolymers of styrenic monomers and another copolymerizable monomer, where the styrenic monomers make up at least 50 mole percent of the monomeric units in the copolymer. Non-limiting examples of styrenic monomers include styrene, p-methyl styrene, α-methyl styrene, tertiary butyl styrene, dimethyl styrene, nuclear brominated or chlorinated derivatives thereof and combinations thereof. Non-limiting examples of suitable copolymerizable monomers include 1,3-butadiene, $C_1$-$C_{32}$ linear, cyclic or branched alkyl (meth) acrylates (specific non-limiting examples include butyl (meth)acrylate, ethyl (meth)acrylate, methyl (meth)acrylate, and 2-ethylhexyl (meth)acrylate), acrylonitrile, vinyl acetate, alpha-methylethylene, divinyl benzene, maleic anhydride, maleic acid, fumaric acid, $C_1$-$C_{12}$ linear, branched or cyclic mono- and di-alkyl esters of maleic acid, $C_1$-$C_{12}$ linear, branched or cyclic mono- and di-alkyl esters of fumaric acid, itaconic acid, $C_1$-$C_{12}$ linear, branched or cyclic mono- and di-alkyl esters of itaconic acid, itaconic anhydride and combinations thereof.

As used herein, the terms "(meth)acrylic" and "(meth) acrylate" are meant to include both acrylic and methacrylic acid derivatives, such as the corresponding alkyl esters often referred to as acrylates and (meth)acrylates, which the term "(meth)acrylate" is meant to encompass.

As used herein, the term "molding" refers to the shaping of a pliable material to assume a new desired shape. Molding can involve the use of specific molding tools such as male and female molding tools, sculptured platens, and the like. It can also include the use of specifically shaped core members including compressible core members that are used to impart a desired shape to at least a portion of a thermoplastic material.

As used herein, the term "expansion factor" refers to the volume a given weight of expanded polymer bead occupies, typically expressed as cc/g.

Generally, the load bearing structures and workstations according to the present invention include a trapezoidal shaped platform adapted to insulate a person from the conditions of the surface on which the workstation is placed. As non-limiting examples, the workstation can insulate the feet of a person from hot or cold temperature extremes and/or reduce the fatigue of standing by providing a cushioning effect. Although the workstation can be trapezoidal, in many instances the workstation will be rectangular or square in shape.

Referring to FIGS. 1-9, embodiments of the present invention provide a flagman workstation 10 that includes a top surface 2; a bottom surface 14; and left, right, rear and front sides 16, 18, 20, and 22 respectively. In this embodiment, each of left, right, rear and front sides 16, 18, 20, and 22 are tapered. Flagman workstation 10 is made, at least in part, of an expandable polymer matrix having a density of at least 5 kg/$m^3$.

In these embodiments of the invention, top surface 12 provides a place for a flagman to stand. Top surface 12 can be parallel to bottom surface 14 or it can be angled to facilitate the drainage of liquids from top surface 12.

The taper of left, right, rear and front sides 16, 18, 20, and 22 form an angle defined by the bottom surface and the lowest edge of the tapered side to the top surface. This angle is shown as a in FIG. 6. Taper angle $\alpha$ can be at least about 1°, in some cases at least about 5°, and in other cases at least about 7° and can be up to about 60°, in some cases up to about 50°, in other cases up to about 40°, in some instances up to about 30° and in other instances up to about 20°. The angle $\alpha$ can be any value or range between any of the values indicated above and is typically steep enough to provide an easy transition from the surface under Flagman workstation 10, but not so steep as to cause a tripping hazard. In particular embodiments, angle $\alpha$ is from 1 to 60 degrees.

In embodiments of the invention, flagman workstation 10 is generally rectangular in shape.

In either trapezoidal or rectangular embodiments, front side 22 and rear side 20 can be at least about 50 cm (20 inches), in some cases at least about 60 cm (24 inches), and in other cases at least about 75 cm (35 inches) and can be up to about 152 cm (60 inches), in some cases up to about 140 cm (55 inches) and in other cases up to about 127 cm (50 inches) in length. The length of front side 22 and rear side 20 can be any value or range between any of the values indicated above and is typically long enough to accommodate a flagman, but not too long that it would obstruct traffic.

In other trapezoidal or rectangular embodiments, right side 18 and left side 16 can be at least about 40 cm (16 inches), in some cases at least about 50 cm (20 inches), and in other cases at least about 60 cm (24 inches) and can be up to about 140 cm (55 inches), in some cases up to about 120 cm (47 inches) and in other cases up to about 101 cm (40 inches) in length. The length of right side 16 and left side 18 can be any value or range between any of the values indicated above and is typically long enough to accommodate a flagman, but not too long that it would obstruct traffic.

In embodiments of the invention, the height of top surface 12, measured from bottom surface 14 to top surface 12 can be at least about 1.25 cm (0.5 inches), in some cases at least about 2.5 cm (1 inch), and in other cases at least about 2.75 cm (1.5 inches) high and can be up to about 15 cm (6 inches), in some cases up to about 13 cm (5 inches) and in other cases up to about 10 cm (4 inches) high. The height of top surface 12 can be any value or range between any of the values indicated above and is typically high enough to provide a flagman a view of the traffic to be controlled and insulate his feet from the road surface but not so high as to create a hazard.

Figure 9:
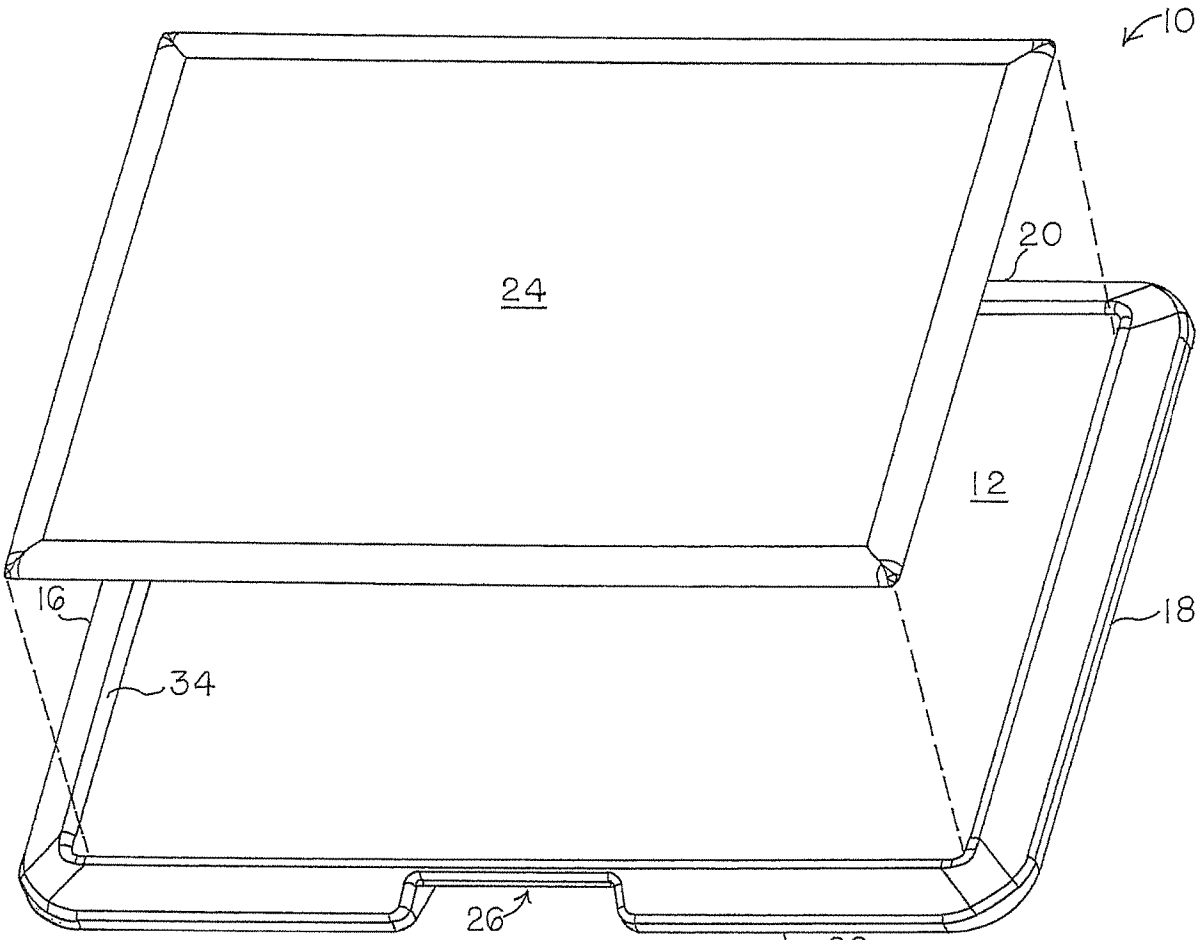
FIG. 9 is a top perspective view of a flagman workstation according to the invention.
Figure 10:
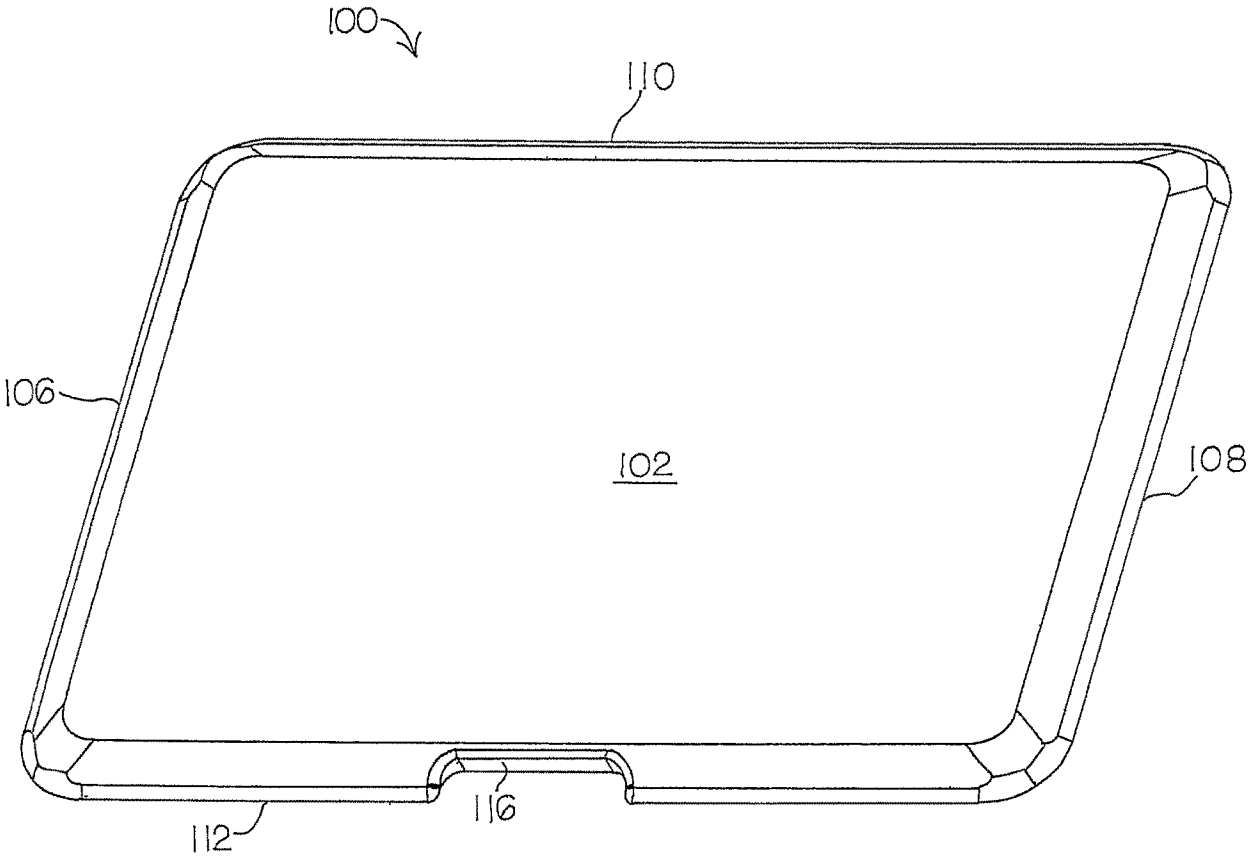
FIG. 10 is top perspective view of another flagman workstation according to the invention.
Figure 13:
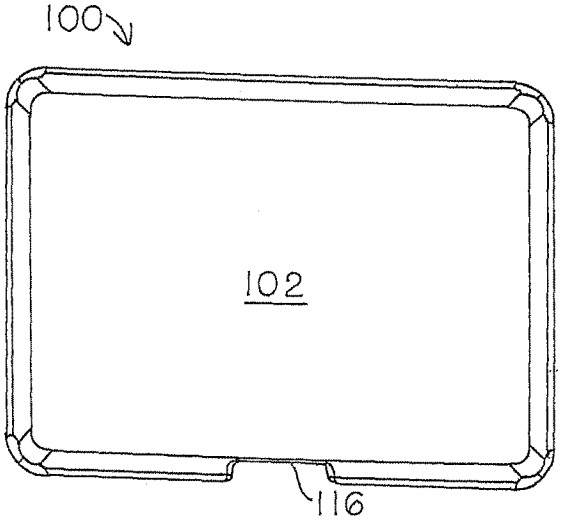
FIG. 13 is a top plan view of another flagman workstation according to the invention.
Figure 12:
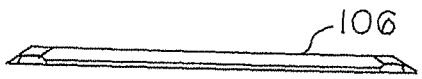
FIG. 12 is a left side elevation view of another flagman workstation according to the invention.
Figure 14:
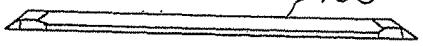
FIG. 14 is a right side elevation view of another flagman workstation according to the invention.
Figure 15:
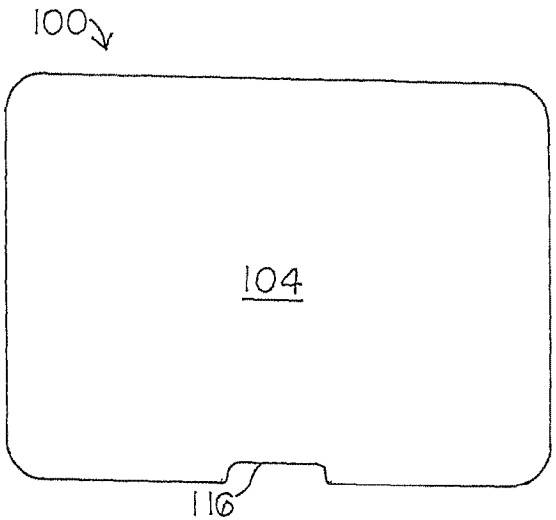
FIG. 15 is a bottom plan view of another flagman workstation according to the invention.
Figure 11:
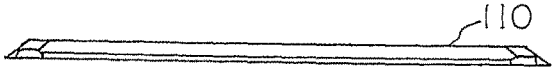
FIG. 11 is a rear elevation view of another flagman workstation according to the invention.
Figure 16:
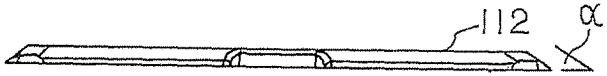
FIG. 16 is a front elevation view of another flagman workstation according to the invention.
Figure 17:
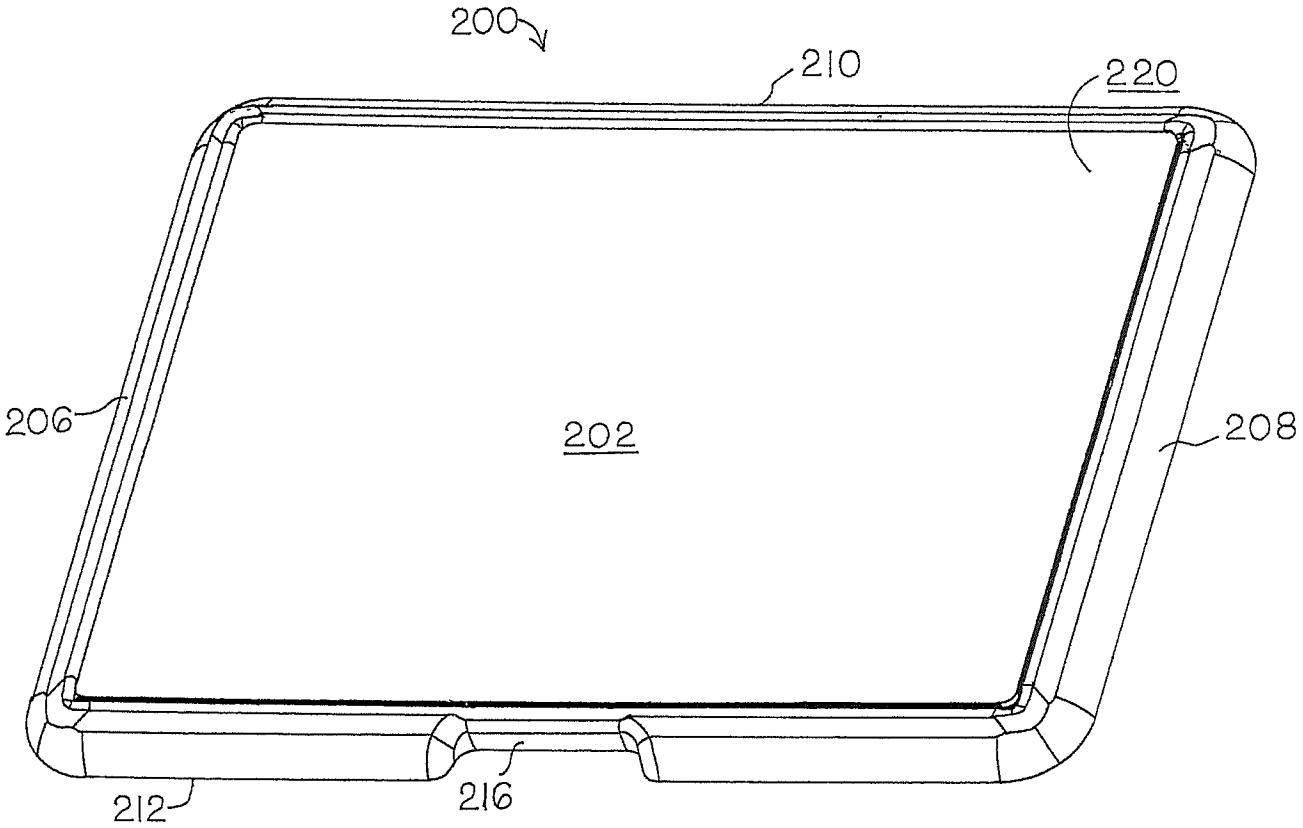
FIG. 17 is a top perspective view of a further flagman workstation according to the invention.
Figure 22:
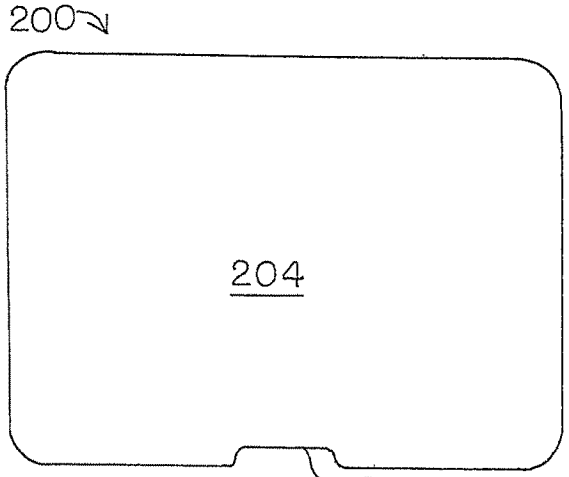
FIG. 22 is a bottom plan view of a further flagman workstation according to the invention.
Figure 18:
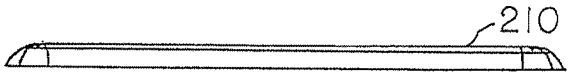
FIG. 18 is a rear elevation view of a further flagman workstation according to the invention.
Figure 23:
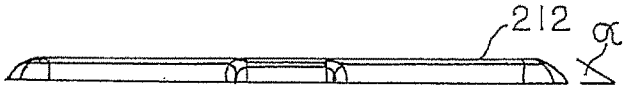
FIG. 23 is a front elevation view of a further flagman workstation according to the invention.
Figure 20:
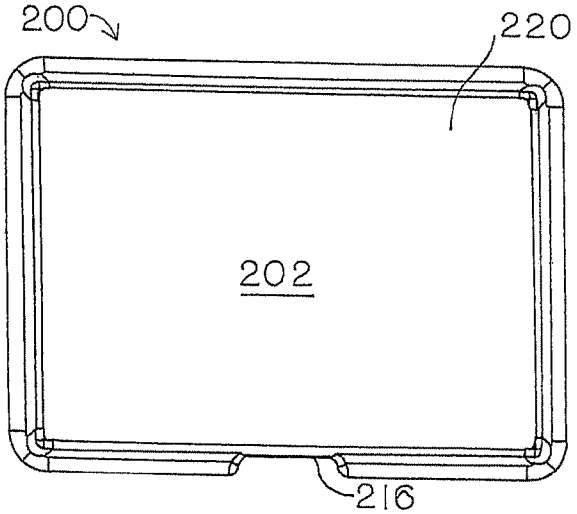
FIG. 20 is a top plan view of a further flagman workstation according to the invention.
Figure 19:
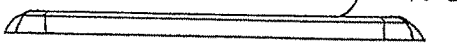
FIG. 19 is a left side elevation view of a further flagman workstation according to the invention.
Figure 21:
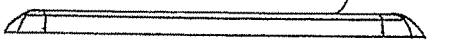
FIG. 21 is a right side elevation view of a further flagman workstation according to the invention.
Figure 24:
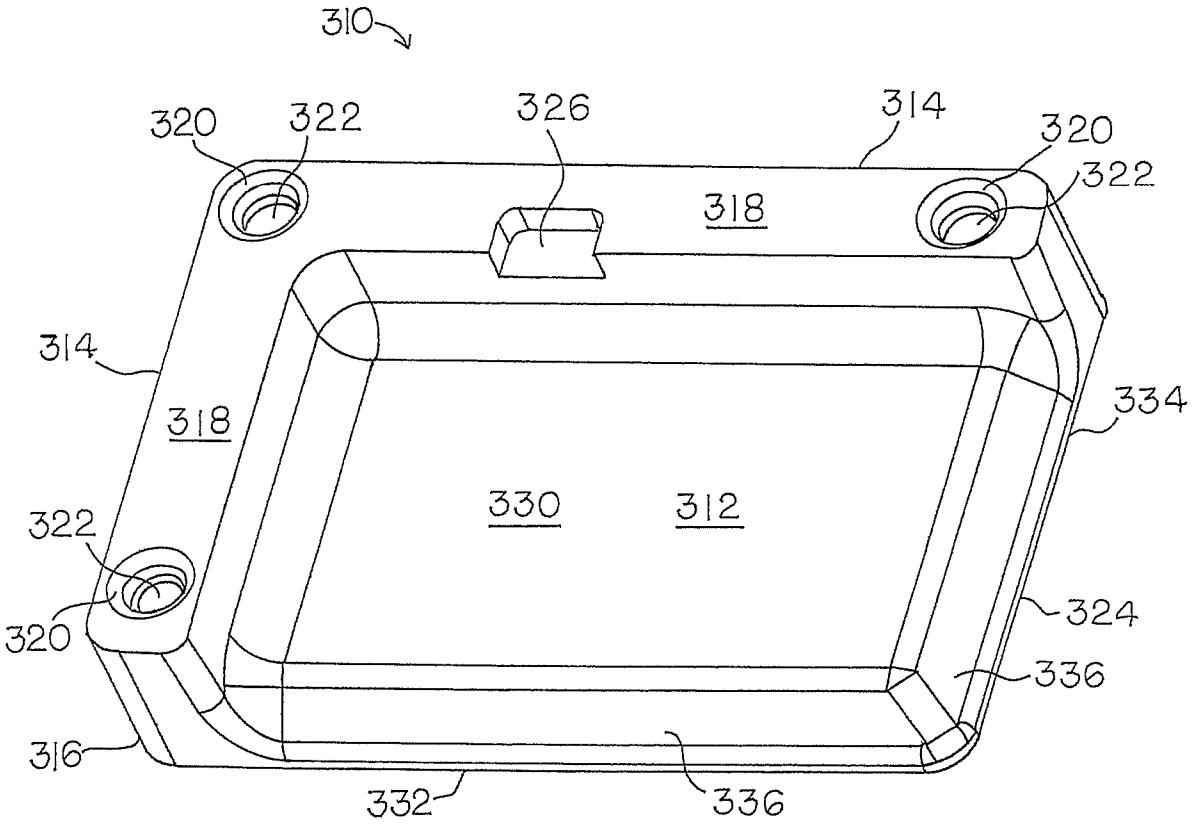
FIG. 24 is a top perspective view of an additional flagman workstation according to the invention.
Figure 25:
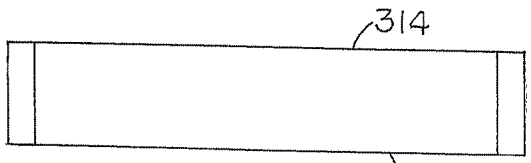
FIG. 25 is a rear elevation view of an additional flagman workstation according to the invention.
Figure 30:
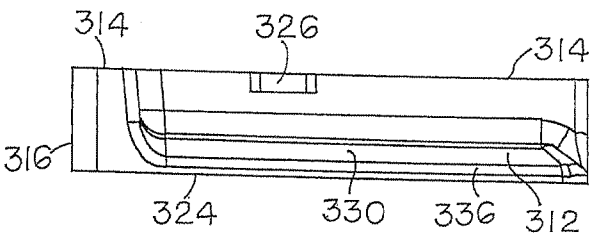
FIG. 30 is a front elevation view of an additional flagman workstation according to the invention.
Figure 28:
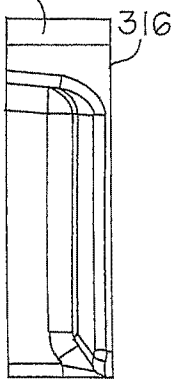
FIG. 28 is a right side elevation view of an additional flagman workstation according to the invention.
Figure 26:
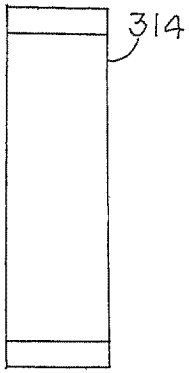
FIG. 26 is a left side elevation view of an additional flagman workstation according to the invention.
Figure 27:
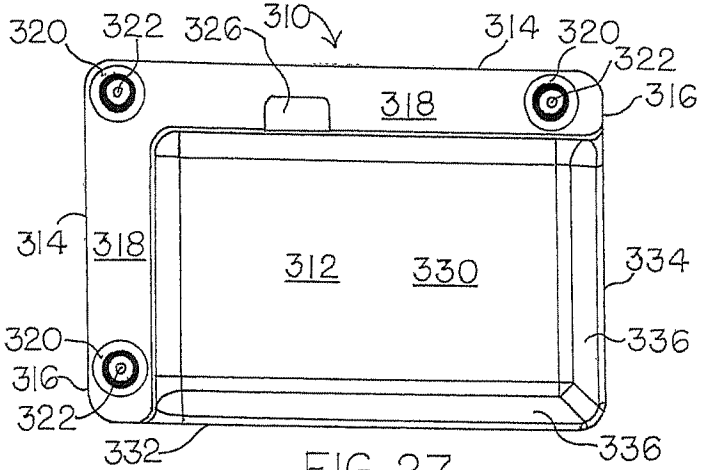
FIG. 27 is a top plan view of an additional flagman workstation according to the invention.
Figure 29:
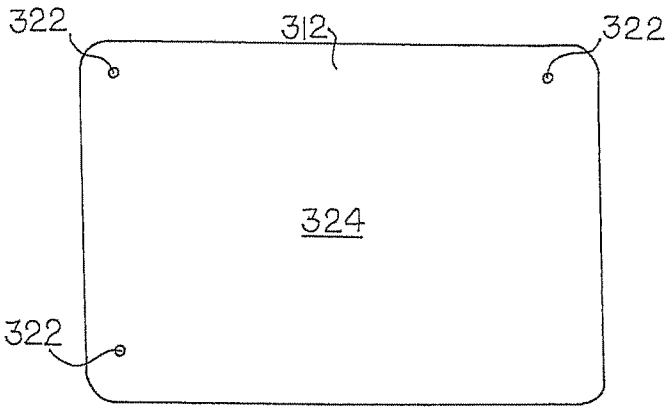
FIG. 29 is a bottom plan view of an additional flagman workstation according to the invention.

In embodiments of the invention, a non-slip surface 24 (as shown in FIG. 9) or strips of a non-slip surface can be applied to top surface 12 to prevent a flagman from slipping during inclement weather conditions and to facilitate comfort or cushioning to the feet. Adhesives known in the art can be used to apply the non-slip surface 24 to top surface 12. In particular embodiments, a locator recess 34 can be molded into top surface 12 parallel to each of sides 16, 18, 20, and 22 adapted to accept non-slip surface 24.

In embodiments of the invention, a non-slip surface can be laminated to bottom surface 14 to provide a stronger grip to the road surface and prevent unnecessary or unwanted movement of flagman workstation 10.

In embodiments of the invention, flagman workstation 10 can be entirely molded from the expandable polymer matrix.

In other embodiments of the invention, a portion of flagman station 10 can be molded hollow or cored out to reduce the weight of flagman station 10.

In embodiments of the invention, flagman workstation 10 is adapted to provide for easy nesting and stacking for transporting to a location and to minimize volume while being stored.

In embodiments of the invention, flagman workstation 10 has one or more channels provided in bottom surface 14, adapted to direct liquids or water away from or underneath flagman workstation 10 in order to reduce the force from water run-off that might otherwise cause unwanted repositioning of flagman workstation 10 on a road surface.

In embodiments of the invention, flagman workstation 10 includes a notch 26 adapted to act as a handle to provide an easy method to pick up and carry flagman workstation 10. In particular embodiments, a beveled surface 30 slopes from bottom surface 14 to notch 26. The configuration in this embodiment provides an ergonomic position for a user's hand to hold flagman workstation 10.

In selected embodiments where notch 26 and beveled surface 30 are employed, the length of right side 18 and left side 16 are adapted to allow for flagman workstation 10 to comfortably fit between the armpit and hand of a user for ease of carrying. As such, rear side 20 would fit under the user's armpit and the users hand would easily grasp handle 32 formed by notch 26 and beveled surface 30. In this embodiment, the length of right side 18 and left side 16 can be at least about 50 cm (20 inches), in some cases at least about 60 cm (24 inches) and can be up to about 81 cm (32 inches), in some cases up to about 76 cm (30 inches) in length. The length of right side 16 and left side 18 in this embodiment can be any value or range between any of the values indicated above.

In various embodiments, the area of top surface 12 is at least about 1275 $cm^2$ (196 $in^2$), in some cases at least about 1500 $cm^2$ (231 $in^2$), and in other cases at least about 1750 $cm^2$ (270 $in^2$) and can be up to about 20,000 $cm^2$ (3,100 $in^2$), in some cases up to about 7,025 $cm^2$ (1,100 $in^2$) and in other cases up to about 5,800 $cm^2$ (900 $in^2$). The area of top surface 12 will vary based on its intended use and can be any of the values or range between any of the values recited above.

Referring to FIGS. 10-16, embodiments of the present invention provide an additional flagman workstation 100 that includes a top surface 102; a bottom surface 104; and left, right, rear and front sides 106, 108, 110, and 112 respectively. In this embodiment, each of left, right, rear and front sides 106, 108, 110, and 112 are tapered. Flagman workstation 100 is made, at least in part, of an expandable polymer matrix having a density of at least 5 $kg/m^3$.

In these embodiments of the invention, top surface 102 provides a place for a flagman to stand. Top surface 102 can be parallel to bottom surface 104 or it can be angled to facilitate the drainage of liquids from top surface 102.

The taper of left, right, rear and front sides 106, 108, 110, and 112 form an angle defined by the bottom surface and the lowest edge of the tapered side to the top surface. This angle is shown as a in FIG. 16. Taper angle $\alpha$ can be at least about 1°, in some cases at least about 5°, and in other cases at least about 7° and can be up to about 60°, in some cases up to about 50°, in other cases up to about 40°, in some instances up to about 30° and in other instances up to about 20°. The angle $\alpha$ can be any value or range between any of the values indicated above and is typically steep enough to provide an easy transition from the surface under Flagman workstation 100, but not so steep as to cause a tripping hazard. In particular embodiments, angle $\alpha$ is from 1 to 60 degrees.

In embodiments of the invention, flagman workstation 100 is generally rectangular in shape. As such, front side 112 and rear side 110 can be at least about 50 cm (20 inches), in some cases at least about 60 cm (24 inches), and in other cases at least about 75 cm (35 inches) and can be up to about 152 cm (60 inches), in some cases up to about 140 cm (55 inches) and in other cases up to about 127 cm (50 inches) in length. The length of front side 112 and rear side 110 can be any value or range between any of the values indicated above and is typically long enough to accommodate a flagman, but not too long that it would obstruct traffic.

In other embodiments of the invention, right side 106 and left side 108 can be at least about 40 cm (16 inches), in some cases at least about 50 cm (20 inches), and in other cases at least about 60 cm (24 inches) and can be up to about 140 cm (55 inches), in some cases up to about 120 cm (47 inches) and in other cases up to about 101 cm (40 inches) in length. The length of right side 106 and left side 108 can be any value or range between any of the values indicated above and is typically long enough to accommodate a flagman, but not too long that it would obstruct traffic.

In embodiments of the invention, the height of top surface 102, measured from bottom surface 104 to top surface 102 can be at least about 1.25 cm (0.5 inches), in some cases at least about 2.5 cm (1 inch), and in other cases at least about 2.75 cm (1.5 inches) high and can be up to about 15 cm (6 inches), in some cases up to about 13 cm (5 inches) and in other cases up to about 10 cm (4 inches) high. The height of top surface 102 can be any value or range between any of the values indicated above and is typically high enough to provide a flagman an view of the traffic to be controlled and insulate his feet from the road surface but so high as to create a hazard.

In embodiments of the invention, a non-slip surface or strips of a non-slip surface can be applied to top surface 102 to prevent a flagman from slipping during inclement weather conditions. Adhesives known in the art can be used to apply the non-slip surface to top surface 102. In particular embodiments, locator recesses can be molded into top surface 102 to accept non-slip strips.

In embodiments of the invention, a non-slip surface can be laminated to bottom surface 104 to provide a stronger grip to the road surface and prevent unnecessary or unwanted movement of flagman workstation 100.

In embodiments of the invention, flagman workstation 100 can be entirely molded from the expandable polymer matrix.

In other embodiments of the invention, a portion of flagman station 100 can be molded hollow or cored out to reduce the weight of flagman station 100.

In embodiments of the invention, flagman workstation 100 is adapted to provide for easy nesting and stacking for transporting to a location and to minimize volume while being stored.

In embodiments of the invention, flagman workstation 100 has one or more channels provided in bottom surface 104, adapted to direct liquids or water away from or underneath flagman workstation 100 in order to reduce the force from water run-off that might otherwise cause unwanted re-positioning of flagman workstation 100 on a road surface.

In embodiments of the invention, flagman workstation 100 includes a notch 116 adapted to act as a handle to provide an easy method to pick up and carry flagman workstation 100.

Referring to FIGS. 17-23, further embodiments of the present invention provide a flagman workstation 200 that includes a top surface 202; a bottom surface 204; and left, right, rear and front sides 206, 208, 210, and 212 respectively. In this embodiment, each of left, right, rear and front sides 206, 208, 210, and 212 are tapered. Flagman workstation 200 is made, at least in part, of an expandable polymer matrix having a density of at least 5 $kg/m^3$.

In these embodiments of the invention, top surface 202 provides a place for a flagman to stand. Top surface 202 can be parallel to bottom surface 204 or it can be angled to facilitate the drainage of liquids from top surface 202. In embodiments of the invention, top surface 202 can be adapted to accept a layer of material 220 to facilitate comfort or cushioning to the feet and/or a non-slip surface. A non-limiting example of an adaptation would be a recess in top surface 202 in approximately the same dimensions as layer of material 220.

Non-limiting examples of suitable layer of material 220 include, rubber matting, carpeting, burlap, viscoelastic polyurethane foam, low-resilience polyurethane foam, foamed polyethylene and foamed polypropylene.

The taper of left, right, rear and front sides 206, 208, 210, and 212 form an angle defined by the bottom surface and the lowest edge of the tapered side to the top surface. This angle is shown as α in FIG. 23. Taper angle α can be at least about 1°, in some cases at least about 5°, and in other cases at least about 7° and can be up to about 60°, in some cases up to about 50°, in other cases up to about 40°, in some instances up to about 30° and in other instances up to about 20°. The angle α can be any value or range between any of the values indicated above and is typically steep enough to provide an easy transition from the surface under Flagman workstation 200, but not so steep as to cause a tripping hazard. In particular embodiments, angle α is from 1 to 60 degrees.

In embodiments of the invention, flagman workstation 200 is generally rectangular in shape. As such, front side 212 and rear side 210 can be at least about 50 cm (20 inches), in some cases at least about 60 cm (24 inches), and in other cases at least about 75 cm (35 inches) and can be up to about 152 cm (60 inches), in some cases up to about 140 cm (55 inches) and in other cases up to about 127 cm (50 inches) in length. The length of front side 212 and rear side 210 can be any value or range between any of the values indicated above and is typically long enough to accommodate a flagman, but not too long that it would obstruct traffic.

In other embodiments of the invention, right side 206 and left side 208 can be at least about 40 cm (16 inches), in some cases at least about 50 cm (20 inches), and in other cases at least about 60 cm (24 inches) and can be up to about 140 cm (55 inches), in some cases up to about 120 cm (47 inches) and in other cases up to about 101 cm (40 inches) in length. The length of right side 206 and left side 208 can be any value or range between any of the values indicated above and is typically long enough to accommodate a flagman, but not too long that it would obstruct traffic.

In embodiments of the invention, the height of top surface 202, measured from bottom surface 204 to top surface 202 can be at least about 1.25 cm (0.5 inches), in some cases at least about 2.5 cm (1 inch), and in other cases at least about 2.75 cm (1.5 inches) high and can be up to about 15 cm (6 inches), in some cases up to about 13 cm (5 inches) and in other cases up to about 10 cm (4 inches) high. The height of top surface 102 can be any value or range between any of the values indicated above and is typically high enough to provide a flagman a view of the traffic to be controlled and insulate his feet from the road surface but so high as to create a hazard.

In embodiments of the invention, a non-slip surface or strips of a non-slip surface can be applied to top surface 202 to prevent a flagman from slipping during inclement weather conditions. Adhesives known in the art can be used to apply the non-slip surface to top surface 202. In particular embodiments, a locator recesses can be molded into top surface 202 to accept non-slip material or strips.

In embodiments of the invention, a non-slip surface can be laminated to bottom surface 204 to provide a stronger grip to the road surface and prevent unnecessary or unwanted movement of flagman workstation 200.

In embodiments of the invention, flagman workstation 200 can be entirely molded from the expandable polymer matrix.

In other embodiments of the invention, a portion of flagman station 200 can be molded hollow or cored out to reduce the weight of flagman station 200.

In embodiments of the invention, flagman workstation 200 is adapted to provide for easy nesting and stacking for transporting to a location and to minimize volume while being stored.

In embodiments of the invention, flagman workstation 200 has one or more channels provided in bottom surface 204, adapted to direct liquids or water away from or underneath flagman workstation 200 in order to reduce the force from water run-off that might otherwise cause unwanted re-positioning of flagman workstation 200 on a road surface.

In embodiments of the invention, flagman workstation 200 includes a notch 216 adapted to act as a handle to provide an easy method to pick up and carry flagman workstation 200.

Referring to FIGS. 24-30, embodiments of the present invention provide a flagman workstation 310 that includes a base 312, at least one riser 314 having a top surface 318 extending from a first side 316 of base 312 and at least one depression 320 in the top surface adapted to receive a traffic control device (not shown). The flagman workstation is made, at least in part, from an expandable polymer matrix having a density of at least 5 kg/m$^3$.

In embodiments of the invention, depression 320 in the top surface 318 of flagman workstation 310 includes an opening 322 extending from depression 320 to bottom surface 324 of flagman workstation 310 adapted to allow liquids to drain out of depression 320.

In embodiments of the invention, a notch 326 can be placed in riser 314 to act as a handle or to facilitate an efficient grip to carry flagman workstation 310.

In embodiments of the invention, a platform surface 330 is provided on base 312, which provides a place for a flagman to stand. Platform surface 330 can be parallel to bottom surface 324 or it can be angled to facilitate the drainage of liquids from platform surface 330 such that the distance from platform surface 330 to bottom surface 324 is at its maximum where platform surface 330 meets riser 314 and the distance from platform surface 330 to bottom surface 324 is at its minimum where platform surface 330 meets front edge 332 and/or right edge 334. In some embodiments, front edge 332 and/or right edge 334 can be beveled to create a sharper angle from where beveled edge 336 meets platform surface 330 and where beveled edge 336 meets bottom surface 324.

In embodiments of the invention, flagman workstation 310 is generally rectangular in shape. As such, front edge 332 can be at least about 60 cm (24 inches), in some cases at least about 76 cm (30 inches), and in other cases at least about 90 cm (35 inches) and can be up to about 200 cm (80 inches), in some cases up to about 175 cm (70 inches) and in other cases up to about 150 cm (60 inches) in length. The length of front edge 332 can be any value or range between any of the values indicated above and is typically long enough to accommodate a flagman, but not too long that it would obstruct traffic.

In other embodiments of the invention, right edge 334 can be at least about 60 cm (24 inches), in some cases at least about 76 cm (30 inches), and in other cases at least about 90 cm (35 inches) and can be up to about 200 cm (80 inches), in some cases up to about 175 cm (70 inches) and in other cases up to about 150 cm (60 inches) in length. The length of right edge 334 can be any value or range between any of the values indicated above and is typically long enough to accommodate a flagman, but not too long that it would obstruct traffic.

In additional embodiments of the invention, top surface 318 of riser 314 can be at least about 5 cm (2 inches), in some cases at least about 8 cm (3 inches), and in other cases at least about 10 cm (4 inches) wide and can be up to about 36 cm (14 inches), in some cases up to about 31 cm (12 inches) and in other cases up to about 25 cm (10 inches) wide. The width of top surface 318 of riser 314 can be any value or range between any of the values indicated above and is typically wide enough to accommodate notch 326 and depression 320, but not so wide as to encroach on the space required for a flagman to stand on platform surface 330.

In embodiments of the invention, the height of riser 314, measured from bottom surface 324 to top surface 318 of riser 314 can be at least about 10 cm (4 inches), in some cases at least about 15 cm (6 inches), and in other cases at least about 18 cm (7 inches) high and can be up to about 40 cm (16 inches), in some cases up to about 35 cm (14 inches) and in other cases up to about 30 cm (12 inches) high. The height of riser 314 can be any value or range between any of the values indicated above and is typically high enough to accommodate notch 326 and depression 320.

In embodiments of the invention, the height of platform surface 330, measured from bottom surface 324 to platform surface 330 can be at least about 1.25 cm (0.5 inches), in some cases at least about 2.5 cm (1 inch), and in other cases at least about 2.75 cm (1.5 inches) high and can be up to about 15 cm (6 inches), in some cases up to about 13 cm (5 inches) and in other cases up to about 10 cm (4 inches) high. The height of platform surface 330 can be any value or range between any of the values indicated above and is typically high to provide a flagman an view of the traffic to be controlled and insulate his feet from the road surface and is not as high as riser 314.

In embodiments of the invention, the height of riser 314 is at least about 1.25 cm (0.5 inches), in some cases at least about 2.5 cm (1 inch), and in other cases at least about 2.75 cm (1.5 inches) higher than the height of platform surface 30 and can be up to about 15 cm (6 inches), in some cases up to about 13 cm (5 inches) and in other cases up to about 10 cm (4 inches) higher than the height of platform surface 330. The height of riser 314 can be any value or range between any of the values indicated above.

In embodiments of the invention, a non-slip surface or strips of a non-slip surface can be applied to platform surface 330 to prevent a flagman from slipping during inclement weather conditions. Adhesives known in the art can be used to apply the non-slip surface to platform surface 330. In particular embodiments, locator recesses can be molded into platform surface 330 to accept non-slip strips. In embodiments of the invention, a non-slip surface can be laminated to bottom surface 324 to provide a stronger grip to the road surface and prevent unnecessary or unwanted movement of flagman workstation 310.

In embodiments of the invention, flagman workstation 310 can be entirely molded from the expandable polymer matrix.

In other embodiments of the invention, a portion of flagman station 310 can be molded hollow or cored out to reduce the weight of flagman station 310.

In embodiments of the invention, flagman workstation 310 is adapted to provide for easy nesting and stacking for transporting to a location and to minimize volume while being stored.

In embodiments of the invention, flagman workstation 310 has one or more channels provided in bottom surface 324, adapted to direct liquids or water away from or underneath flagman workstation 310 in order to reduce the force from water run-off that might otherwise cause unwanted re-positioning of flagman workstation 310 on a road surface.

In particular embodiments of the invention, flagman workstation 310 is in the shape of a rectangle and has a platform surface 330 that is from 1.25 cm to 15 cm high, a riser 14 that is from 1.25 cm to 15 cm higher than platform surface 330, a front edge 332 length of from 75 to 150 cm and right edge length of from 65 to 140 cm.

In embodiments of the invention, platform surface 330 generally has dimensions defined by the length of front edge 332 and right edge 334, less the width of top surface 318 of riser 314 and is large enough for a man wearing work boots to stand. As such, the area of platform surface 330 is at least about 1275 $cm^2$ (196 $in^2$), in some cases at least about 1500 $cm^2$ (231 $in^2$), and in other cases at least about 1750 $cm^2$ (270 $in^2$) and can be up to about 20,000 $cm^2$ (3,100 $in^2$), in some cases up to about 7,025 $cm^2$ (1,100 $in^2$) and in other cases up to about 5,800 $cm^2$ (900 $in^2$). The area of platform surface 330 will vary based on its intended use and can be any of the values or range between any of the values recited above.

In embodiments of the invention, poles or supports can be placed in depressions 320 arrayed and adapted to support a platform approximately parallel and in substantially the same shape as top surface 318 of riser 314. In this embodiment, workstation 310 can be used for alternative purposes such as selling items at events, conducting music ensembles and speaking to gatherings of people.

The various embodiments of the structures and workstations according to the invention can optionally have a portion of the overall surface, substantially all of the overall surface or all of the overall surface of the flagman workstation coated with a water resistant coating. Non-limiting examples of suitable water resistant coatings include those containing polyurea, polyurethane, polyethylene, polypropylene, polybutene, polyisobutylene, poly(meth)acrylates; epoxy resin and combinations thereof.

In embodiments of the invention, when the water resistant coating is applied to the structures and workstations described herein, the structures and workstations are able to be used for longer periods of time compared with structures and workstations made of the same materials but without the water resistant coating.

The non-slip surface is meant to minimize the user's feet slipping while standing on the flagman workstation as well as to facilitate comfort or cushioning to the user's feet. As such, non-skid and cushioning materials known in the art can be used as the non-slip surface. Non-limiting examples include, but are not limited to a rubber matting, carpeting, burlap, viscoelastic polyurethane foam, low-resilience polyurethane foam, foamed polyethylene, foamed polypropylene, polyester fabric with surface applied polyvinyl chloride available under the trade name Slip-not available from Seattle Fabrics Inc.; a polyester cotton blend fabric with rubber dots on one side available under the trade name Grip-Tight Cloth available from James Thompson & Co Inc.; a nitrile enhanced nitricell sponge available under the tradename Diamond-Plate SpongeCote® available from Wearwell, Inc.; foamed polyvinyl chloride, and artificial turf in the form of mats containing fibers, filaments and ribbon-like plastic such as those sold under the trade names Astro Turf® available from Textile Management Associates, Inc. and SYNLAWN® available from UTGH Equipment, LLC.

In many embodiments of the invention, the thickness of the non-slip surface and the depth of the locator recess are adapted such that the top surface of the non-slip surface is flush or at the same height of the highest point of the left, right, rear and front sides of the flagman workstation.

Although the embodiments of the invention described above depict a notch or bevel and notch as a handle to facilitate carrying or otherwise transporting the flagman workstations according to the invention, these embodiments are not intended to be limiting. As non-limiting examples, a rope, plastic strap, or a strap of leather or a suitable fabric can be attached to the front side of the flagman workstation to similarly facilitate carrying or otherwise transporting the flagman workstations according to the invention.

The present invention also provides a method of controlling the flow of traffic that includes:

placing a flagman workstation at both ends of a portion of roadway where traffic is to be controlled;

stationing a flagman standing on the platform surface at each flagman workstation equipped with a pole mounted sign having a male end and a sign end, the sign having a directional message such as "STOP" on a first side and a directional message such as "SLOW" on a second side;

placing the male end of the pole mounted sign in a depression in the flagman workstation; and rotating the pole mounted sign so that the traffic entering the controlled roadway views the appropriate message.

In embodiments of the invention, the flagman workstation is made from an expandable polymer matrix that includes resins selected from expandable polystyrene, expandable polyolefins, rubber modified styrenic polymers where the styrenic polymer constitutes a continuous phase and the rubber constitutes a dispersed phase in the resin, rubber modified styrenic polymers where the rubber constitutes a continuous phase and the styrenic polymer constitutes a dispersed phase in the resin, polyphenylene oxide, an interpolymer of a polyolefin and in situ polymerized vinyl aromatic monomers and combinations and blends thereof.

In embodiments of the invention, the flagman workstation is molded from an expandable polymer matrix that includes expandable polystyrene.

In embodiments of the invention, the flagman workstation is molded from an expandable polymer matrix that includes an interpolymer of a polyolefin and in situ polymerized vinyl aromatic monomers.

In embodiments of the invention, the expandable polymer matrix can include pigments or dyes. In some embodiments, the flagman stations disclosed herein are molded in a gray or black color to prevent possible driver distractions, remaining masked on the road surface so drivers remain focused on the flagger and his sign. In other embodiments, the flagman stations can be molded in bright colors, such as yellow or orange in order to alert drivers to the presence of traffic restrictions.

In embodiments of the invention, the polyolefin of the interpolymer is selected from the group consisting of low density polyethylene, medium density polyethylene, high density polyethylene, an ethylene vinyl acetate copolymer, an ethylene/propylene copolymer, a blend of polyethylene and polypropylene, a blend of polyethylene and an ethylene/vinyl acetate copolymer, and a blend of polyethylene and an ethylene/propylene copolymer, ethylene-butyl acrylate copolymer, ethylene-methyl methacrylate copolymer and combinations thereof.

In embodiments of the invention, the vinyl aromatic monomers of the interpolymer are selected from the group consisting of styrene, alpha-methylstyrene, ethylstyrene, chlorostyrene, bromostyrene, vinyltoluene, vinylbenzene, and isopropylxylene and admixtures thereof.

In embodiments of the invention, the polyolefin is present in the interpolymer resin particles at a level of from 20% to 80%, in some cases 30% to 70% and in other cases 40% to 60% by weight based on the weight of the interpolymer resin particles and the vinyl aromatic monomers or resulting polymers are present in the interpolymer resin particles at a level of from 20% to 80%, in some cases 30% to 70% and in other cases 40% to 60% based on the weight of the interpolymer resin particles.

In embodiments the invention, the flagman workstation can be made from an expandable polymer matrix, which can include one or more expandable plastics.

Suitable expandable plastics include, but are not limited to interpolymers of a polyolefin and in situ polymerized vinyl aromatic monomers, expandable polystyrene (EPS), expandable styrenic polymers, expandable polyolefins, rubber modified styrenic polymers where the styrenic polymer constitutes a continuous phase and the rubber constitutes a dispersed phase in the resin, rubber modified styrenic polymers where the rubber constitutes a continuous phase and the styrenic polymer constitutes a dispersed phase in the resin as described in U.S. Pat. No. 7,638,559, the relevant portions of which are herein incorporated by reference, polyphenylene oxide, and combinations and blends thereof.

In an embodiment of the invention, the expandable plastics can include one or more polymers selected from homopolymers of vinyl aromatic monomers; copolymers of at least one vinyl aromatic monomer with one or more of divinylbenzene, conjugated dienes, alkyl methacrylates, alkyl acrylates, acrylonitrile, and/or maleic anhydride; polyolefins; polycarbonates; polyesters; polyamides; natural rubbers; synthetic rubbers; and combinations thereof.

In a particular embodiment of the invention, the expandable plastics include thermoplastic homopolymers or copolymers selected from homopolymers derived from vinyl aromatic monomers including styrene, isopropylstyrene, alpha-methylstyrene, nuclear methylstyrenes, chlorostyrene, tert-butylstyrene, and the like, as well as copolymers prepared by the copolymerization of at least one vinyl aromatic monomer as described above with one or more other monomers, non-limiting examples being divinylbenzene, conjugated dienes (non-limiting examples being butadiene, isoprene, 1,3- and 2,4-hexadiene), alkyl methacrylates, alkyl acrylates, acrylonitrile, and maleic anhydride, wherein the vinyl aromatic monomer is present in at least 50% by weight of the copolymer. In an embodiment of the invention, styrenic polymers are used, particularly polystyrene. However, other suitable polymers can be used, such as polyolefins (e.g., polyethylene, polypropylene), polycarbonates, polyphenylene oxides, and mixtures thereof.

In a more particular embodiment of the invention, the expandable plastics include expandable polystyrene (EPS) particles. These particles can be in the form of beads, granules, or other particles convenient for the expansion and molding operations.

In the present invention, the expandable plastics can be particles polymerized in a suspension process, which are essentially spherical resin beads useful for making expandable polymer particles. However, polymers derived from solution and bulk polymerization techniques that are extruded and cut into particle sized resin bead sections can also be used.

In an embodiment of the invention, resin beads (unexpanded) of expandable plastics containing any of polymers or polymer compositions described herein can have a particle size of at least 0.2, in some situations at least 0.33, in some cases at least 0.35, in other cases at least 0.4, in some instances at least 0.45 and in other instances at least 0.5 mm. Also, the resin beads can have a particle size of up to 3, in some instances up to 2, in other instances up to 2.5, in some cases up to 2.25, in other cases up to 2, in some situations up to 1.5 and in other situations up to 1 mm. The resin beads used in this embodiment can be any value or can range between any of the values recited above.

The expandable plastic particles or resin beads can optionally be impregnated using any conventional method with a suitable blowing agent. As a non-limiting example, the impregnation can be achieved by adding the blowing agent to the aqueous suspension during the polymerization of the polymer, or alternatively by re-suspending the polymer particles in an aqueous medium and then incorporating the blowing agent as taught in U.S. Pat. No. 2,983,692. Any gaseous material or material which will produce gases on heating can be used as the blowing agent. Conventional blowing agents include aliphatic hydrocarbons containing 4 to 6 carbon atoms in the molecule, such as butanes, pentanes, hexanes, and the halogenated hydrocarbons, e.g., CFC's and HCFC's, which boil at a temperature below the softening point of the polymer chosen. Mixtures of these aliphatic hydrocarbon blowing agents can also be used.

Alternatively, water can be blended with these aliphatic hydrocarbons blowing agents or water can be used as the sole blowing agent as taught in U.S. Pat. Nos. 6,127,439; 6,160,027; and 6,242,540 in these patents, water-retaining agents are used. The weight percentage of water for use as the blowing agent can range from 1 to 20%. The texts of U.S. Pat. Nos. 6,127,439, 6,160,027 and 6,242,540 are incorporated herein by reference.

The impregnated resin beads are optionally pre-expanded to a bulk density of at least 0.5 lb/ft$^3$ (0.008 g/cc), in some cases at least 1.25 lb/ft$^3$ (0.02 g/cc), in other cases at least 1.5 lb/ft$^3$ (0.024 g/cc), in some situations at least 1.75 lb/ft$^3$ (0.028 g/cc), in some circumstances at least 2 lb/ft$^3$ (0.032 g/cc) in other circumstances at least 3 lb/ft$^3$ (0.048 g/cc) and in particular circumstances at least 3.25 lb/ft$^3$ (0.052 g/cc) or 3.5 lb/ft$^3$ (0.056 g/cc). When non-expanded resin beads are used, higher bulk density beads can be used. As such, the bulk density can be as high as 40 lb/ft$^3$ (0.64 g/cc). The bulk density of the pre-expanded polymer particles can be any value or range between any of the values recited above.

The expansion step is conventionally carried out by heating the impregnated beads via any conventional heating medium, such as steam, hot air, hot water, or radiant heat. One generally accepted method for accomplishing the pre-expansion of impregnated thermoplastic particles is taught in U.S. Pat. No. 3,023,175.

The impregnated resin beads can be foamed cellular polymer particles as taught in U.S. Patent Application Publication No. US 2002/0117769 A1, the teachings of which are incorporated herein by reference. The foamed cellular particles can be polystyrene that are expanded and contain a volatile blowing agent at a level of less than 14 wt %, in some situations less than 6 wt %, in some cases ranging from about 2 wt % to about 5 wt %, and in other cases ranging from about 2.5 wt % to about 3.5 wt % based on the weight of the polymer.

The expandable polymer matrix can include an interpolymer of a polyolefin and in situ polymerized vinyl aromatic monomers and optionally other expandable polymers.

In embodiments of the invention, the interpolymer of a polyolefin and in situ polymerized vinyl aromatic monomers is one or more of those described in U.S. Pat. Nos. 3,959,189; 4,168,353; 4,303,756, 4,303,757 and 6,908,949, the relevant portions of which are herein incorporated by reference. A non-limiting example of such interpolymers that can be used in the present invention include those available under the trade name ARCEL®, available from NOVA Chemicals Inc., Pittsburgh, Pa. and PIOCELAN®, available from Sekisui Plastics Co., Ltd., Tokyo, Japan.

In embodiments of the invention, when the expandable polymer matrix comprises greater than 50% of the interpolymer of a polyolefin and in situ polymerized vinyl aromatic monomers, the structures and workstations described herein provide improved strength and integrity to support the weight of a person compared to structures and workstations made of expandable polystyrene of the same density.

In embodiments of the invention, when the expandable polymer matrix comprises greater than 50% of the interpolymer of a polyolefin and in situ polymerized vinyl aromatic monomers, the structures and workstations provide improved cushioning and comfort to the feet of a person compared to structures and workstations made of expandable polystyrene of the same density.

In embodiments of the invention, the interpolymer of a polyolefin and in situ polymerized vinyl aromatic monomers is a particle or resin bead, which is subsequently processed to form the load bearing structures according to the present invention. The interpolymer particles used in the invention include a polyolefin and an in situ polymerized vinyl aromatic resin that form an interpenetrating network of polyolefin and vinyl aromatic resin particles. The interpolymer particles are impregnated with a blowing agent and optionally, a plasticizer.

Such interpolymer particles can be obtained by processes that include suspending polyolefin particles and vinyl aromatic monomer or monomer mixtures in an aqueous suspension and polymerizing the monomer or monomer mixtures inside the polyolefin particles. Non-limiting examples of such processes are disclosed in U.S. Pat. Nos. 3,959,189, 4,168,353 and 6,908,949.

In an embodiment of the invention, the polyolefin includes one or more polyethylene resins selected from low-, medium-, and high-density polyethylene, an ethylene vinyl acetate copolymer, an ethylene/propylene copolymer, a blend of polyethylene and polypropylene, a blend of polyethylene and an ethylene/vinyl acetate copolymer, and a blend of polyethylene and an ethylene/propylene copolymer. Ethylene-butyl acrylate copolymer and ethylene-methyl methacrylate copolymer can also be used.

The amount of polyolefin in the interpolymer resin particles of the invention can be at least 20%, in some cases at least 25%, and in other cases at least 30% and can be up to 80%, in some cases up to 70%, in other cases up to 60% and in some instances up to 55%, by weight based on the weight of the interpolymer resin particles. The amount of polyolefin in the interpolymer resin particles can be any value or range between any of the values recited above.

The amount of polymerized vinyl aromatic resin in the interpolymer resin particles of the invention ranges can be at least 20%, in some cases at least 30%, in other cases at least 40% and in some instances at least 45% and can be up to 80%, in some cases up to 75% and in other cases up to 70%, by weight based on the weight of the interpolymer resin particles. The amount of polymerized vinyl aromatic resin in the interpolymer resin particles can be any value or range between any of the values recited above.

The vinyl aromatic resin can be made up of polymerized vinyl aromatic monomers or the resin can be a copolymer containing monomeric units from vinyl aromatic monomers and copolymerizable comonomers. Non-limiting examples of vinyl aromatic monomers that can be used in the invention include styrene, alpha-methylstyrene, ethylstyrene, chlorostyrene, bromostyrene, vinyltoluene, vinylbenzene, and isopropylxylene. These monomers may be used either alone or in admixture.

Non-limiting examples of copolymerizable comonomers include 1,3-butadiene, $C_1$-$C_{32}$ linear, cyclic or branched alkyl (meth)acrylates (specific non-limiting examples include butyl (meth)acrylate, ethyl (meth)acrylate and 2-ethylhexyl (meth)acrylate), acrylonitrile, vinyl acetate, alpha-methylethylene, divinyl benzene, maleic anhydride, itaconic anhydride, dimethyl maleate and diethyl maleate.

Non-limiting examples of vinyl aromatic copolymers that can be used in the invention include those disclosed in U.S. Pat. No. 4,049,594. Specific non-limiting examples of suitable vinyl aromatic copolymers include copolymers containing repeat units from polymerizing styrene and repeat units from polymerizing one or more monomers selected from 1,3-butadiene, $C_1$-$C_{32}$ linear, cyclic or branched alkyl (meth)acrylates (specific non-limiting examples including butyl (meth)acrylate, ethyl (meth)acrylate and 2-ethylhexyl (meth)acrylate), acrylonitrile, vinyl acetate, alpha-methylethylene, divinyl benzene, maleic anhydride, itaconic anhydride, dimethyl maleate and diethyl maleate.

In particular embodiments of the invention, the vinyl aromatic resin includes polystyrene or styrene-butyl acrylate copolymers.

In general, the interpolymer resin particles are formed as follows: The polyolefin particles are dispersed in an aqueous medium prepared by adding 0.01 to 5%, in some cases 2 to 3%, by weight based on the weight of the water of a suspending agent such as water soluble high molecular weight materials, e.g., polyvinyl alcohol or methyl cellulose or slightly water soluble inorganic materials, e.g., calcium phosphate or magnesium pyrophosphate and soap, such as sodium dodecyl benzene sulfonate, and the vinyl aromatic monomers are added to the suspension and polymerized inside the polyolefin particles.

Any conventionally known and commonly used suspending agents for polymerization of vinyl aromatic monomers can be employed. These agents are well known in the art and can be freely selected by one skilled in the art. Initially, the water is in an amount generally from 0.7 to 5, preferably 3 to 5 times that of the starting polyolefin particles employed in the aqueous suspension, on a weight basis, and gradually the ratio of the polymer particles to the water may reach around 1:1.

The polymerization of the vinyl aromatic monomers, which is absorbed in the polyolefin particles, is carried out using initiators.

The initiators suitable for suspension polymerization of the vinyl aromatic monomers are generally used in an amount of about 0.05 to 2 percent by weight, in some cases 0.1 to 1 percent by weight, based on the weight of the vinyl aromatic monomer. Non-limiting examples of suitable initiators include organic peroxides such as benzoyl peroxide, lauroyl peroxide, t-butyl perbenzoate and t-butyl perpivalate and azo compounds such as azobisisobutylonitrile and azobisdimethylvaleronitrile.

These initiators can be used alone or two or more initiators can be used in combination. In many cases, the initiators are dissolved in the vinyl aromatic monomers, which are to be absorbed in the polyolefin particles. In other cases, the initiator can be dissolved in a solvent, such as toluene, benzene, and 1,2-dichloropropane.

When the in situ polymerization of the vinyl aromatic monomers is completed, the polymerized vinyl aromatic resin is uniformly dispersed inside the polyolefin particles.

In many cases the polyolefin particles are cross-linked. The cross-linking can be accomplished simultaneously with the polymerization of the vinyl aromatic monomer in the polyolefin particles, and before impregnation of the blowing agent and/or plasticizer. For this purpose, cross-linking agents are used. Such cross-linking agents include, but are not limited to di-t-butyl-peroxide, t-butyl-cumylperoxide, dicumyl-peroxide, α,α-bis-(t-butylperoxy)-p-diisopropylbenzene, 2,5-dimethyl-2,5-di-(t-butylperoxy)-hexyne-3,2,5-dimethyl-2,5-di-(benzoylperoxy)-hexane and t-butyl-peroxyisopropyl-carbonate. These cross-linking agents are absorbed in the polyolefin particles together with the vinyl aromatic monomers by dissolving the cross-linking agent in an amount of about 0.1 to 2 weight % and in some cases 0.5 to 1 weight %, based on the weight of the polyolefin particles suspended in water. Further details of the cross-linking agents and the manner for absorbing the cross-linking agents into the polyolefin particles are provided in U.S. Pat. No. 3,959,189.

In an embodiment of the invention, the interpolymer of a polyolefin and in situ polymerized vinyl aromatic monomers includes a rubber modified styrenic polymers where the rubber constitutes a continuous phase and the styrenic polymer constitutes a dispersed phase in the resin as described in U.S. Pat. No. 7,638,559, the relevant portions of which are herein incorporated by reference.

The resulting expandable polymer matrix can be used as raw materials in producing structures and workstations. The blowing agent and/or plasticizer are introduced into the expandable polymer matrix resin particles to form foamable or expandable particles or resin beads, which in turn, are used to mold structures and workstations.

The blowing agent should have a boiling point lower than the softening point of the polyolefin and should be gaseous or liquid at room temperature (about 20 to 30° C.) and normal pressure (about atmospheric). Blowing agents are well known in the art and generally have boiling points ranging from −42° C. to 80° C., more generally, from −10° C. to 36° C. Suitable hydrocarbon blowing agents include, but are not limited to aliphatic hydrocarbons such as n-propane, n-butane, iso-butane, n-pentane, iso-pentane, n-hexane, and neopentane, cycloaliphatic hydrocarbons such as cyclobutane and cyclopentane, and halogenated hydrocarbons such as methyl chloride, ethyl chloride, methylene chloride, trichlorofluoromethane, dischlorofluoromethane, dichlorodifluormethane, chlorodifluoromethane and dichioroetetrafluoroethane, etc. These blowing agents can be used alone or as mixtures. If n-butane, ethyl chloride, and dichlorotetrafluoroethane, which are gaseous at room temperature and normal pressure, are used as a mixture, it is possible to achieve foaming to a low bulk density. Specific types of volatile blowing agents are taught in U.S. Pat. No. 3,959,180. In particular embodiments of the invention, the blowing agent is selected from n-pentane, iso-pentane, neopentane, cylcopentane, and mixtures thereof.

The amount of the blowing agent ranges from about 1.5% to about 20% by weight, in some cases about 1.5% to 15% by weight, and in other cases from 5% to 15% by weight, based on the weight of the expandable polymer matrix.

A plasticizer can be used in combination with the blowing agent and as stated herein above and acts as a blowing aid in the invention.

Suitable plasticizers include, but are not limited to benzene, toluene, limonene, linear, branched or cyclic $C_5$ to $C_{20}$ alkanes, white oil, linear, branched or cyclic $C_1$ to $C_{20}$ dialkylphthalates, styrene, oligomers of styrene, oligomers of (meth)acrylates having a glass transition temperature less than polystyrene, and combinations thereof.

In a particular embodiment of the invention, the plasticizer includes limonene, a mono-terpene hydrocarbon existing widely in the plant world. The known types are d-limonene, l-limonene, and dl-limonene. D-limonene is contained in the skin of citrus fruits and is used in food additives as a fragrant agent; its boiling point is about 176° C.; and its flammability is low. D-limonene is a colorless liquid, has a pleasant orange-like aroma, is approved as a food additive, and is widely used as a raw material of perfume. Limonene is not a hazardous air pollutant.

The amount of plasticizer can range from about 0.1 to 5 parts and in some cases from about 0.1 to about 1 part, by weight per 100 parts by weight of the expandable polymer matrix.

In embodiments of the invention, the interpolymer particles can be produced as follows: In a first reactor, the polyolefin particles are suspended in an aqueous medium containing a dispersing agent. The dispersing agent can be polyvinyl alcohol, methylcellulose, calcium phosphate, magnesium pyrophosphate, calcium carbonate, tricalcium phosphate, etc. The amount of dispersing agent employed can be from 0.01 to 5% by weight based on the amount of water. A surfactant can be added to the aqueous medium. Generally, the surfactant is used to lower the surface tension of the suspension and helps to emulsify the water/vinyl aromatic monomer in mixture in the initiator and wax mixes, if used. Suitable waxes include polyethylene waxes and ethylene bistearamide. The aqueous medium is generally heated to a temperature at which the vinyl aromatic monomers can be polymerized, i.e., from about 60° C. to about 120° C. over a period of time, for example, 12 to 20 hours. Over this 12 to 20 hour period, the vinyl aromatic monomers, the vinyl aromatic polymerization initiator, and the cross-linking agent are added to the resulting suspension containing the polyolefin particles, which are dispersed in the aqueous medium. These materials may be added all at one time, or gradually in individual portions.

The interpolymer particles are acidified, dewatered, screened, and subsequently charged to a second reactor where the particles are impregnated with the blowing agent and/or plasticizer.

The impregnation step can be carried out by suspending the interpolymer particles in an aqueous medium, adding the blowing agent and/or plasticizer to the resulting suspension, and stirring at a temperature of, preferably, about 40° C. degrees to 80° C. The blowing agent and/or plasticizer can be blended together and then added to the interpolymer particles or can be added to the interpolymer particles separately.

Alternatively, the blowing agent and/or plasticizer can be added to the first reactor during or after the polymerization process.

The above processes describe a wet process for impregnation of the interpolymer particles. Alternatively, the interpolymer particles can be impregnated via an anhydrous process similar to that taught in Column 4, lines 20-36 of U.S. Pat. No. 4,429,059.

In an embodiment of the invention, the blowing agent can be dosed to the expandable polymer matrix in an extruder to produce resin pellets or beads. The extruder acts to mix the blowing agent into the expandable polymer matrix prior to extruding a strand of the mixture. The strand can be cut into bead or pellet lengths using an appropriate device, a non-limiting example being an underwater face cutter.

The particles and/or beads of the expandable polymer matrix according to the invention can also contain other additives known in the art, non-limiting examples including anti-static additives; flame retardants; colorants or dyes; filler materials and combinations thereof. Other additives can also include chain transfer agents, non-limiting examples including $C_{2-15}$ alkyl mercaptans, such as n-dodecyl mercaptan, t-dodecyl mercaptan, t-butyl mercaptan and n-butyl mercaptan, and other agents such as pentaphenyl ethane and the dimer of alpha-methyl styrene. Other additives can further include nucleating agents, non-limiting examples including polyolefin waxes, i.e., polyethylene waxes.

The expandable polymer matrix can include interpolymers of a polyolefin and in situ polymerized vinyl aromatic monomers and optionally other expandable polymers. The other expandable polymers include those polymers that can provide desirable properties to the load bearing platform of the invention and that are compatible with the interpolymers of a polyolefin and in situ polymerized vinyl aromatic monomers. Non-limiting examples of other expandable polymers that can be used in the present invention include expandable polystyrene (EPS), expandable polyolefins, rubber modified styrenic polymers where the styrenic polymer constitutes a continuous phase and the rubber constitutes a dispersed phase in the resin, rubber modified styrenic polymers where the rubber constitutes a continuous phase and the styrenic polymer constitutes a dispersed phase in the resin as described in U.S. Pat. No. 7,638,559, the relevant portions of which are herein incorporated by reference, polyphenylene oxide, and combinations and blends thereof.

The expandable polymer matrix can contain 100% interpolymers of a polyolefin and in situ polymerized vinyl aromatic monomers, but can also contain up to 99%, in some cases up to 95%, in other cases up to 90%, in some instances up to 80% and in other instances up to 75% based on the weight of the expandable polymer matrix of interpolymers of a polyolefin and in situ polymerized vinyl aromatic monomers. Also, the expandable polymer matrix can contain at least 25%, in some cases at least 30%, in other cases at least 40% and in some instances at least 50% based on the weight of the expandable polymer matrix of interpolymers of a polyolefin and in situ polymerized vinyl aromatic monomers. The amount of interpolymers of a polyolefin and in situ polymerized vinyl aromatic monomers in the expandable polymer matrix can be any value or range between any of the values recited above.

When other expandable polymers are included in the expandable polymer matrix with the expandable polymer matrix of interpolymers of a polyolefin and in situ polymerized vinyl aromatic monomers, the other expandable polymers can be present at a level of at least 1%, in some cases at least 5%, in other cases at least 10%, in some instances at least 20% and in other instances at least 25% based on the weight of the expandable polymer matrix. Also, the other expandable polymers can be present in the expandable polymer matrix at a level of up to 75%, in some cases up to 70%, in other cases up to 60% and in some instances up to 50% based on the weight of the expandable polymer matrix. The other expandable polymers can be included in the expandable polymer matrix at any level or range between any of the values recited above.

In embodiments of the invention, any of the thermoplastics and resins described above can optionally include other additives, as a non-limiting example ultraviolet (UV) stabilizers, heat stabilizers, flame retardants, structural enhancements, biocides, and combinations thereof.

The density of the expanded polymer matrix in structures and workstations can be at least 5, in some cases at least 10 and in other cases at least 15 kg/m$^3$ and can be up to 40, in some cases up to 35 and in other cases up to 30 kg/m$^3$.

In embodiments of the invention, the density of the expanded polymer matrix in structures and workstations corresponding to the top surface is higher than the density of the expanded polymer matrix in the remainder of the structures and workstations. This feature aids in preventing stress breakage at the thinnest portions of the structures and workstations.

The structures and workstations can be prepared by heating beads of the expandable polymer matrix using a heating medium such as steam. Depending on the desired density in any portion of the flagman workstation, the beads are expanded to an expansion ratio (the ratio of expanded bead volume/initial bead volume) of from 5 to 100, in some cases from 10 to 90, in other cases from 20 to 80, in some instances from 30 to 75 and in other instances from 40 to 70.

The beads of the expandable polymer matrix according to the invention can be formed into a structures and workstations of a desired configuration by pre-expanding the beads and further expanding and shaping them in a mold cavity. The resulting load bearing structure has superior thermal stability, chemical resistance (e.g., oil resistance), and flexural strength compared to expandable polystyrene.

In many embodiments of the invention, the pre-expanded beads or particles containing the expandable polymer matrix are molded into a structures and workstation shape of desired dimensions by adding pre-expanded particles or beads after four to 48 hours of ageing to completely fill a mold of the desired shape and dimensions and molding in a steam molding press. When steam is applied uniformly to the pre-expanded particles or beads, good fusion between beads is accomplished. When heat is also applied from the mold and/or mold press, a skin can be formed on the outer surface of the molded flagman workstation.

In many embodiments of the invention, when steam is applied uniformly to the pre-expanded interpolymer particles or beads, good fusion between beads is accomplished and a skin is formed on the outer surface of the structures and workstations during the molding process. This skin provides a surface that readily accepts paint as well as laminating resins.

In some embodiments, the pre-expanded beads or particles are molded into a generally rectangular shape mold. The structures and workstations are then prepared by cutting the general structure or workstation shape into the block molded foam.

In embodiments of the invention, the structures and workstations are directly molded into its desired shape as described above to form a skin and/or by applying a sealant to the surface of the flagman workstation.

Any sealant coating can be used that provides water repellant properties to the surface of the structures and workstations and provide a surface that accepts laminating resins with little to no wrinkling or other surface deformation. Suitable sealants are formulations that include, but are not limited to, ethylene-vinyl acetate copolymers, ethylene-vinyl alcohol copolymers, ethylene-acrylic acid copolymers, styrene-butadiene polymers, styrene-isoprene polymers; styrene-butadiene-styrene block polymers; styrene-isoprene-styrene block polymers; and hydrogenated resins thereof and combinations thereof.

Other materials that can be used as or as part of the sealant, in some instances, include joint compound, gypsum paste, polyurethanes, styrenic block copolymers, polypropylene, and polyethylene.

In some embodiments, the sealant can be multilayered, including layers that contain any of the materials indicated above. Having one or more layers and the composition of those layers is determined based on the composition of the structures and workstations and the composition of the upper layer covering and under layer covering. As a non-limiting example, sealant can include three components, a thermoplastic polyolefin; a thermoplastic styrenic polymer; and a styrenic block copolymer.

In some instances, the sealant includes film structures containing from 35 to 65 weight % of thermoplastic olefin, in some cases, from 55 to 60 weight %; from 10 to 30 weight % thermoplastic styrenic polymer, in some cases, from 15 to 20 weight %, with the balance being a styrenic block copolymer.

In particular instances, the sealant can include from 20 to 60 weight % polypropylene, in some cases, 40 to 50 weight %; from 20 to 60 weight % polystyrene, in some cases, from 40 to 50 weight %, with the balance being a styrenic block copolymer.

The styrenic block copolymer used in the sealant can be a copolymer of at least one vinyl aromatic monomer and at least one other olefin, diolefin and/or diene monomer. In particular embodiments, the styrene block copolymers can contain blocks of styrene and blocks of butadiene with from about 35 to 55 weight % bound styrene and a number average molecular weight (determined using gel permeation chromatography with polystyrene standards) of from about 50,000 to about 100,000. Non-limiting example of suitable styrenic block copolymers are those available under the trademark KRATON® from KRATON Polymers U.S. L.L.C. of Houston, Tex.

In some embodiments, the sealant includes multilayer structures that contain at least three layers, a thermoplastic polyolefin layer (TPO); a thermoplastic vinyl aromatic layer (TVA); and a tie layer (TL) which is located between the TLO layer and the TVA layer. This can be described as a TPO/TL/TVA structure. In some specific embodiments, the sealant can include film structures containing five layers, with the TVA layer being the core layer, as a non-limiting example, a five layer structure can be described as TPO/TL/TVA/TL/TPO.

When the sealant includes multilayer films, in many cases, the sealant contains about 5 to 25 weight % of tie layer material (based on the total weight of the multilayer structure). The tie layers can be used in amounts of from 5 to 10 weight % when preparing sheet structures, though it is possible to prepare useful structures, which contain less than 1% tie layer material. The amount of material used in the other layers can be widely varied to suit different end use. As a non-limiting example, a multilayer film containing similar amounts of polyolefin and thermoplastic styrenic polymer (e.g., from 10 to 20 weight % "tie layer" and 40-50 weight % in each of the TPO and TVA layers).

It is also within the scope of the invention to pre-mix the tie layer material with a part of the material used for one of the outer layers. This method can be used when only a very small weight % of the overall structure is contained in either the TPO layer of the TVA layer.

In embodiments of the invention, the flagman workstations described herein have a measured water absorption (measured according to ASTM C-272) of less than 2, in some cases, less than 1, and, in other cases, less than 0.5 volume percent determined on a sample molded to a density of from 1.5 to 2.5 lb/ft$^3$ (0.024 to 0.04 g/cc).

In other embodiments of the invention, the structures and workstations described herein are made from materials that have a flexural strength at 5% strain (measured according to ASTM C-203) of at least 20 psi, in some cases, at least 25 psi and, in other cases, at least 30 psi at a molded density of about 1.5 lb/ft$^3$ (0.024 g/cc); at least 30 psi, in some cases, at least 35 psi and, in other cases, at least 40 psi at a molded density of about 1.75 lb/ft$^3$ (0.028 g/cc); at least 40 psi, in some cases, at least 45 psi and, in other cases, at least 50 psi at a molded density of about 2 lb/ft$^3$ (0.032 g/cc); and at least 60 psi, in some cases, at least 65 psi and, in other cases, at least 70 psi at a molded density of about 2.25 lb/ft$^3$ (0.036 g/cc).

In additional embodiments of the invention, the structures and workstations described herein are made from materials that have a tensile strength (measured according to ASTM D-3575-T) of at least 25 psi, in some cases, at least 30 psi and, in other cases, at least 35 psi at a molded density of about 1.5 lb/ft$^3$ (0.024 g/cc); at least 40 psi, in some cases, at least 45 psi and, in other cases, at least 50 psi at a molded density of about 1.75 lb/ft$^3$ (0.028 g/cc); at least 55 psi, in some cases, at least 60 psi and, in other cases, at least 65 psi at a molded density of about 2 lb/ft$^3$ (0.032 g/cc); and at least 75 psi, in some cases, at least 80 psi and, in other cases, at least 85 psi at a molded density of about 2.25 lb/ft$^3$ (0.036 g/cc).

Although the flagman workstations according to the various embodiments of the invention can be used for traffic control and safety, they can also be used for other activities where standing on cold or hot surfaces or fatigue from standing for long periods of time can better be performed if insulated and/or cushioned. Non-limiting examples of such activities can include use by school crossing guards, drum majors for bands, bartending, automotive repair, referees at sporting events or even for tail-gaiting prior to sporting or entertainment events.

As indicated herein, additional coloring can be applied to the surface of the flagman workstations according to the various embodiments of the invention. As non-limiting examples, bright colors, such as orange or yellow can be applied in whole or in stripes to increase visibility or safety, school colors or insignia can be added for appropriate uses as well as colors and logos consistent with various sporting teams.

The present invention has been described with reference to specific details of particular embodiments thereof. It is not intended that such details be regarded as limitations upon the scope of the invention except insofar as and to the extent that they are included in the accompanying claims.

What is claimed is:

1. A flagman workstation, trapezoidal in shape, comprising a base, tapered sides, a top surface and a bottom surface; wherein the flagman workstation comprises an expandable polymer matrix having a density of at least 5 kg/m$^3$.

2. The flagman workstation according to claim 1, wherein the expandable polymer matrix comprises expandable polystyrene.

3. The flagman workstation according to claim 1, wherein the expandable polymer matrix comprises an interpolymer of a polyolefin and in situ polymerized vinyl aromatic monomers.

4. The flagman workstation according to claim 3, wherein the polyolefin is selected from the group consisting of low density polyethylene, medium density polyethylene, high density polyethylene, an ethylene vinyl acetate copolymer, an ethylene/propylene copolymer, a blend of polyethylene and polypropylene, a blend of polyethylene and an ethylene/vinyl acetate copolymer, and a blend of polyethylene and an ethylene/propylene copolymer, ethylene-butyl acrylate copolymer, ethylene-methyl methacrylate copolymer and combinations thereof.

5. The flagman workstation according to claim 3, wherein the vinyl aromatic monomers are selected from the group consisting of styrene, alpha-methyl-styrene, ethylstyrene, chlorostyrene, bromostyrene, vinyltoluene, vinylbenzene, and isopropylxylene and admixtures thereof.

6. The flagman workstation according to claim 3, wherein the polyolefin is present in the interpolymer resin particles at a level of from 20% to 80% by weight based on the weight of the interpolymer resin particles and the vinyl aromatic monomers or resulting polymers are present in the interpolymer resin particles at a level of from 20% to 80% based on the weight of the interpolymer resin particles.

7. The flagman workstation according to claim 1, wherein the expandable polymer matrix comprises resins selected from expandable polystyrene, expandable polyolefins, rubber modified styrenic polymers where the styrenic polymer constitutes a continuous phase and the rubber constitutes a dispersed phase in the resin, rubber modified styrenic polymers where the rubber constitutes a continuous phase and the styrenic polymer constitutes a dispersed phase in the resin, polyphenylene oxide, an interpolymer of a polyolefin and in situ polymerized vinyl aromatic monomers and combinations and blends thereof.

8. The flagman workstation according to claim 1, wherein the flagman workstation is in the shape of a rectangle and the tapered sides are from 1 to 25 cm high, comprising a front side and a rear side each having a length of from 50 to 152 cm and comprising a left side and a right side each having a length of from 40 to 140 cm.

9. The flagman workstation according to claim 1, wherein the tapered sides form an angle defined by the bottom surface and the lowest edge of the tapered side to the top surface of from 1 to 60 degrees.

10. The flagman workstation according to claim 1 comprising a water resistant coating applied to at least a portion of the overall surface of the flagman workstation.

11. The flagman workstation according to claim 10, wherein the coating comprises polyurea, polyurethane, polyethylene, polypropylene, polybutene, polyisobutylene, poly (meth)acrylates; epoxy resin and combinations thereof.

12. The flagman workstation according to claim 1 comprising a locator recess molded into the top surface adapted to accept a non-slip surface.

13. The flagman workstation according to claim 12 comprising the non-slip surface.

14. The flagman workstation according to claim 13, wherein the non-slip surface is selected from the group of rubber matting, carpeting, burlap, viscoelastic polyurethane foam, low-resilience polyurethane foam, foamed polyethylene, foamed polypropylene, polyester fabric with surface applied polyvinyl chloride, a polyester cotton blend fabric with rubber dots on one side, a nitrile enhanced nitricell sponge, foamed polyvinyl chloride, and artificial turf comprising fibers, filaments or ribbon-like plastic.

15. The flagman workstation according to claim 1 comprising at least one riser having a top surface extending from one side of the base and at least one depression in the top surface adapted to receive a traffic control device.

16. The flagman workstation according to claim 15, wherein the depression in the top surface adapted to receive a traffic control device comprises an opening extending from a bottom surface of the depression to the bottom surface of the flagman workstation adapted to allow liquids to drain out of the depression.

17. A method of controlling the flow of traffic comprising:

placing the flagman workstation according to claim 15 at both ends of a portion of roadway where traffic is to be controlled:

stationing a flagman standing on the upper surface at each flagman workstation equipped with a pole mounted sign having a male end and a sign end, the sign having a first directional message on a first side and a second directional message on a second side;

placing the male end of the pole mounted sign in the depression in the flagman workstation; and rotating the pole mounted sign so that the traffic entering the controlled roadway views the appropriate message.

18. A method of controlling the flow of traffic comprising:

placing the flagman workstation according to claim 1 at both ends of a portion of roadway where traffic is to be controlled:

stationing a flagman standing on the upper surface at each flagman workstation equipped with a pole mounted sign having a male end and a sign end, the sign having a first directional message on a first side and a second directional message on a second side; and rotating the pole mounted sign so that the traffic entering the controlled roadway views the appropriate message.

19. A flagman workstation, rectangular in shape, comprising a base; tapered front, rear, left and right sides; a top surface and a bottom surface;

wherein the flagman workstation comprises an expandable polymer matrix comprising an interpolymer of a polyolefin and in situ polymerized vinyl aromatic monomers having a density of at least 5 $kg/m^3$;

wherein the tapered sides are from 1 to 25 cm high, the front side and the rear side each have a length of from 50 to 152 cm and the left side and the right side each have a length of from 40 to 140 cm;

wherein a water resistant is coating applied to the overall surface of the flagman workstation;

wherein the water resistant coating comprises polyurea, polyurethane, polyethylene, polypropylene, polybutene, polyisobutylene, poly(meth)acrylates; epoxy resin and combinations thereof; and wherein the top surface includes a locator recess molded into and adapted to accept a non-slip surface affixed therein.

20. The flagman workstation according to claim 19 comprising at least one riser having a top surface extending from one side of the base and at least one depression in the top surface adapted to receive a traffic control device; wherein the depression in the top surface adapted to receive a traffic control device comprises an opening extending from a bottom surface of the depression to the bottom surface of the flagman workstation adapted to allow liquids to drain out of the depression.

* * * * *